US007946687B2

(12) United States Patent
McAvoy et al.

(10) Patent No.: US 7,946,687 B2
(45) **Date of Patent: *May 24, 2011**

(54) THERMAL BEND ACTUATOR COMPRISING BENT ACTIVE BEAM HAVING RESISTIVE HEATING BARS

(75) Inventors: Gregory John McAvoy, Balmain (AU); Misty Bagnat, Balmain (AU); Vincent Patrick Lawlor, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 479 days.

This patent is subject to a terminal disclaimer.

(21) Appl. No.: 12/114,826

(22) Filed: May 5, 2008

(65) Prior Publication Data

US 2009/0273646 A1 Nov. 5, 2009

(51) Int. Cl.
*B41J 2/05* (2006.01)

(52) U.S. Cl. ..... 347/63; 347/61; 347/62

(58) Field of Classification Search ..... 347/61–63, 347/68–71

See application file for complete search history.

(56) References Cited

U.S. PATENT DOCUMENTS

| | | | | |
|---|---|---|---|---|
| 6,669,317 | B2 * | 12/2003 | Linder et al. | 347/9 |
| 6,721,020 | B1 | 4/2004 | Delametter et al. | |
| 7,794,055 | B2 * | 9/2010 | McAvoy et al. | 347/56 |
| 2003/0210300 | A1 * | 11/2003 | Silverbrook | 347/54 |
| 2005/0046672 | A1 * | 3/2005 | Cabal et al. | 347/54 |
| 2007/0275080 | A1 * | 11/2007 | Laulicht et al. | 424/493 |
| 2009/0278876 | A1 * | 11/2009 | McAvoy et al. | 347/10 |
| 2010/0079550 | A1 * | 4/2010 | McAvoy et al. | 347/61 |

OTHER PUBLICATIONS

Huang, Q., Lee, N.K.S., "Analysis and Design of Polysilicon Thermal Flexure Actuator", J. Micromech. Microeng. 9 (1999), p. 64-70.

* cited by examiner

*Primary Examiner* — Matthew Luu
*Assistant Examiner* — Henok Legesse

(57) ABSTRACT

A thermal bend actuator comprising: (a) a pair of electrical contacts positioned at one end of the actuator; (b) an active beam connected to the electrical contacts and extending longitudinally away from the contacts, the active beam defining a bent current flow path between the contacts; and (c) a passive beam fused to the active beam. When a current is passed through the active beam, the active beam heats and expands relative to the passive beam, resulting in bending of the actuator. The active beam comprises a resistive heating bar having a relatively smaller cross-sectional area than any other part of the current flow path. Heating of the active beam is concentrated in the heating bar.

7 Claims, 4 Drawing Sheets

THERMAL BEND ACTUATOR COMPRISING BENT ACTIVE BEAM HAVING RESISTIVE HEATING BARS

FIELD OF THE INVENTION

This invention relates to inkjet nozzle assemblies. It has been developed primarily to improve the efficiency of thermal bend actuated inkjet nozzles.

CO-PENDING APPLICATION

The following application has been filed by the Applicant simultaneously with this application: U.S. application Ser. No. 12/114,827(U.S. Publilcation No. 2009/0278876).

The disclosure of this co-pending application is incorporated herein by reference.

CROSS REFERENCES

The following patents or patent applications filed by the applicant or assignee of the present invention are hereby incorporated by cross-reference.

| | | | | | | |
|---|---|---|---|---|---|---|
| 6,276,850 | 6,520,631 | 6,158,907 | 6,539,180 | 6,270,177 | 6,405,055 | 6,628,430 |
| 6,835,135 | 6,626,529 | 6,981,769 | 7,125,338 | 7,125,337 | 7,136,186 | 7,286,260 |
| 7,145,689 | 7,130,075 | 7,081,974 | 7,177,055 | 7,209,257 | 6,443,555 | 7,161,715 |
| 7,154,632 | 7,158,258 | 7,148,993 | 7,075,684 | 10/943,905 | 10/943,906 | 10/943,904 |
| 10/943,903 | 10/943,902 | 6,966,659 | 6,988,841 | 7,077,748 | 7,255,646 | 7,070,270 |
| 7,014,307 | 7,158,809 | 7,217,048 | 11/225,172 | 7,341,341 | 11/329,039 | 11/329,040 |
| 7,271,829 | 11/442,189 | 11/474,280 | 11/483,061 | 11/503,078 | 11/520,735 | 11/505,858 |
| 11/525,850 | 11/583,870 | 11/592,983 | 11/592,208 | 11/601,828 | 11/635,482 | 11/635,526 |
| 10/466,440 | 7,215,441 | 11/650,545 | 11/653,241 | 11/653,240 | 7,056,040 | 6,942,334 |
| 11/706,300 | 11/740,265 | 11/737,720 | 11/739,056 | 11/740,204 | 11/740,223 | 11/753,557 |
| 11/750,285 | 11,758,648 | 11/778,559 | 11,834,634 | 11/838,878 | 11,845,669 | 12,015,407 |
| 12/017,331 | 12,030,823 | 6,799,853 | 7,237,896 | 6,749,301 | 10/451,722 | 7,137,678 |
| 7,252,379 | 7,144,107 | 10/503,900 | 10/503,898 | 10/503,897 | 7,220,068 | 7,270,410 |
| 7,241,005 | 7,108,437 | 7,140,792 | 10/503,922 | 7,224,274 | 10/503,917 | 10/503,918 |
| 10/503,925 | 10/503,927 | 10/503,928 | 7,349,777 | 7,354,121 | 7,195,325 | 7,229,164 |
| 7,150,523 | 10/503,889 | 7,154,580 | 6,906,778 | 7,167,158 | 7,128,269 | 6,688,528 |
| 6,986,613 | 6,641,315 | 7,278,702 | 10/503,891 | 7,150,524 | 7,155,395 | 6,915,140 |
| 6,999,206 | 6,795,651 | 6,883,910 | 7,118,481 | 7,136,198 | 7,092,130 | 6,786,661 |
| 6,808,325 | 10/920,368 | 10/920,284 | 7,219,990 | 10/920,283 | 6,750,901 | 6,476,863 |
| 6,788,336 | 6,322,181 | 6,597,817 | 6,227,648 | 6,727,948 | 6,690,419 | 10/470,947 |
| 6,619,654 | 6,969,145 | 6,679,582 | 7,328,896 | 6,568,670 | 6,866,373 | 7,280,247 |
| 7,008,044 | 6,742,871 | 6,966,628 | 6,644,781 | 6,969,143 | 6,767,076 | 6,834,933 |
| 6,692,113 | 6,913,344 | 6,727,951 | 7,128,395 | 7,036,911 | 7,032,995 | 6,969,151 |
| 6,955,424 | 6,969,162 | 10/919,249 | 6,942,315 | 7,354,122 | 7,234,797 | 6,986,563 |
| 7,295,211 | 11/045,442 | 7,286,162 | 7,283,159 | 7,077,330 | 6,196,541 | 7,303,257 |
| 11/185,725 | 7,226,144 | 11/202,344 | 7,267,428 | 11/248,423 | 11/248,422 | 7,093,929 |
| 11/282,769 | 11/330,060 | 11/442,111 | 7,290,862 | 11/499,806 | 11/499,710 | 6,195,150 |
| 11,749,156 | 11,782,588 | 11/854,435 | 11/853,817 | 11/935,958 | 11,924,608 | 6,362,868 |
| 11,970,993 | 12,031,526 | 6,831,681 | 6,431,669 | 6,362,869 | 6,472,052 | 6,356,715 |
| 6,894,694 | 6,636,216 | 6,366,693 | 6,329,990 | 6,459,495 | 6,137,500 | 6,690,416 |
| 7,050,143 | 6,398,328 | 7,110,024 | 6,431,704 | 6,879,341 | 6,415,054 | 6,665,454 |
| 6,542,645 | 6,486,886 | 6,381,361 | 6,317,192 | 6,850,274 | 09/113,054 | 6,646,757 |
| 6,624,848 | 6,357,135 | 6,271,931 | 6,353,772 | 6,106,147 | 6,665,008 | 6,304,291 |
| 6,305,770 | 6,289,262 | 6,315,200 | 6,217,165 | 6,496,654 | 6,859,225 | 6,924,835 |
| 6,647,369 | 6,943,830 | 09/693,317 | 7,021,745 | 6,712,453 | 6,460,971 | 6,428,147 |
| 6,416,170 | 6,402,300 | 6,464,340 | 6,612,687 | 6,412,912 | 6,447,099 | 6,837,567 |
| 6,505,913 | 7,128,845 | 6,733,684 | 7,249,108 | 6,566,858 | 6,331,946 | 6,246,970 |
| 6,442,525 | 7,346,586 | 09/505,951 | 6,374,354 | 7,246,098 | 6,816,968 | 6,757,832 |
| 6,334,190 | 6,745,331 | 7,249,109 | 7,197,642 | 7,093,139 | 10/636,263 | 10/636,283 |
| 10/866,608 | 7,210,038 | 10/902,883 | 10/940,653 | 10/942,858 | 11/706,329 | 11/757,385 |
| 11/758,642 | 12,030,817 | 7,119,836 | 7,283,162 | 7,286,169 | 10/636,285 | 7,170,652 |
| 6,967,750 | 6,995,876 | 7,099,051 | 7,172,191 | 7,243,916 | 7,222,845 | 11/239,232 |
| 7,285,227 | 7,063,940 | 11/107,942 | 7,193,734 | 7,086,724 | 7,090,337 | 7,278,723 |
| 7,140,717 | 11/190,902 | 11/209,711 | 7,256,824 | 7,140,726 | 7,156,512 | 7,186,499 |
| 11/478,585 | 11/525,862 | 7,357,497 | 11/583,875 | 11/592,181 | 6,750,944 | 11/599,336 |
| 7,291,447 | 11,744,183 | 11/758,646 | 11/778,561 | 11/839,532 | 11/838,874 | 11/853,021 |
| 11/869,710 | 11/868,531 | 11,927,403 | 11,951,960 | 12,019,556 | 10/636,225 | 6,985,207 |
| 6,773,874 | 6,650,836 | 7,324,142 | 10/636,224 | 7,250,975 | 7,295,343 | 6,880,929 |
| 7,236,188 | 7,236,187 | 7,155,394 | 10/636,219 | 10/636,223 | 7,055,927 | 6,986,562 |
| 7,052,103 | 7,312,845 | 10/656,281 | 10/656,791 | 10/666,124 | 10/683,217 | 7,289,142 |
| 7,095,533 | 6,914,686 | 6,896,252 | 6,820,871 | 6,834,851 | 6,848,686 | 6,830,246 |
| 6,851,671 | 10/729,098 | 7,092,011 | 7,187,404 | 10/729,159 | 10/753,458 | 6,878,299 |
| 6,929,348 | 6,921,154 | 10/780,625 | 10/804,042 | 6,913,346 | 10/831,238 | 10/831,237 |
| 10/831,239 | 10/831,240 | 10/831,241 | 10/831,234 | 10/831,233 | 7,246,897 | 7,077,515 |
| 10/831,235 | 10/853,336 | 10/853,117 | 10/853,659 | 10/853,681 | 6,913,875 | 7,021,758 |
| 7,033,017 | 7,161,709 | 7,099,033 | 7,147,294 | 7,156,494 | 7,360,872 | 11/011,925 |
| 7,032,998 | 7,044,585 | 7,296,867 | 6,994,424 | 11/006,787 | 7,258,435 | 7,097,263 |
| 7,001,012 | 7,004,568 | 7,040,738 | 7,188,933 | 7,027,080 | 7,025,446 | 6,991,321 |
| 7,131,715 | 7,261,392 | 7,207,647 | 7,182,435 | 7,097,285 | 7,331,646 | 7,097,284 |
| 7,083,264 | 7,147,304 | 7,232,203 | 7,156,498 | 7,201,471 | 11/501,772 | 11/503,084 |
| 11/513,073 | 7,210,764 | 11/635,524 | 11/706,379 | 11/730,386 | 11/730,784 | 11/753,568 |
| 11/782,591 | 11/859,783 | 12,015,243 | 12,037,069 | 6,710,457 | 6,775,906 | 6,507,099 |

-continued

| | | | | | | |
|---|---|---|---|---|---|---|
| 7,221,043 | 7,107,674 | 7,154,172 | 11/442,400 | 7,247,941 | 11/736,540 | 7,307,354 |
| 11/940,304 | 6,530,339 | 6,631,897 | 6,851,667 | 6,830,243 | 6,860,479 | 6,997,452 |
| 7,000,913 | 7,204,482 | 11/212,759 | 11/281,679 | 11/730,409 | 6,238,044 | 6,425,661 |
| 7,364,256 | 7,258,417 | 7,293,853 | 7,328,968 | 7,270,395 | 11/003,404 | 11/003,419 |
| 7,334,864 | 7,255,419 | 7,284,819 | 7,229,148 | 7,258,416 | 7,273,263 | 7,270,393 |
| 6,984,017 | 7,347,526 | 7,357,477 | 7,156,497 | 11/601,670 | 11,748,482 | 11/778,563 |
| 11/779,851 | 11/778,574 | 11/853,816 | 11/853,814 | 11/853,786 | 11/872,037 | 11/856,694 |
| 11,965,703 | 11,971,170 | 12,023,011 | 12,036,896 | 12/050,154 | 11/003,463 | 7,364,255 |
| 12,056,247 | 7,357,476 | 12,050,001 | 11/003,614 | 7,284,820 | 7,341,328 | 7,246,875 |
| 7,322,669 | 11/764,760 | 11,853,777 | 11,955,354 | 12,022,994 | 11/293,800 | 11/293,802 |
| 11/293,801 | 11/293,808 | 11/293,809 | 11/482,975 | 11/482,970 | 11/482,968 | 11/482,972 |
| 11/482,971 | 11/482,969 | 6,431,777 | 6,334,664 | 6,447,113 | 7,239,407 | 6,398,359 |
| 6,652,089 | 6,652,090 | 7,057,759 | 6,631,986 | 7,187,470 | 7,280,235 | 11/501,775 |
| 11,744,210 | 11/859,784 | 12,104,428 | 12,106,333 | 6,471,331 | 6,676,250 | 6,347,864 |
| 6,439,704 | 6,425,700 | 6,588,952 | 6,626,515 | 6,722,758 | 6,871,937 | 11/060,803 |
| 7,344,226 | 7,328,976 | 11/685,084 | 11/685,086 | 11/685,090 | 11/740,925 | 11/763,444 |
| 11/763,443 | 11,946,840 | 11,961,712 | 12/017,771 | 7,249,942 | 7,206,654 | 7,162,324 |
| 7,162,325 | 7,231,275 | 7,146,236 | 7,278,847 | 10/753,499 | 6,997,698 | 7,220,112 |
| 7,231,276 | 10/753,440 | 7,220,115 | 7,195,475 | 7,144,242 | 7,306,323 | 7,306,319 |
| 11/525,858 | 7,322,674 | 11/599,335 | 11/706,380 | 11,736,545 | 11/736,554 | 11/739,047 |
| 11,749,159 | 11/739,073 | 11/775,160 | 11/853,755 | 11/940,291 | 11,934,071 | 11,951,913 |
| 6,786,420 | 6,827,282 | 6,948,661 | 7,073,713 | 10/983,060 | 7,093,762 | 7,083,108 |
| 7,222,799 | 7,201,319 | 11/442,103 | 11/739,071 | 11/518,238 | 11/518,280 | 11/518,244 |
| 11/518,243 | 11/518,242 | 7,032,899 | 6,854,724 | 7,331,651 | 7,334,870 | 7,334,875 |
| 11/357,296 | 11/357,298 | 11/357,297 | 12,015,479 | 12/017,270 | 12,015,218 | 6,350,023 |
| 6,318,849 | 6,592,207 | 6,439,699 | 6,312,114 | 11/246,676 | 11/246,677 | 11/246,678 |
| 11/246,679 | 11/246,680 | 11/246,681 | 11/246,714 | 11/246,713 | 11/246,689 | 11/246,671 |
| 11/246,670 | 11/246,669 | 11/246,704 | 11/246,710 | 11/246,688 | 11/246,716 | 11/246,715 |
| 11/246,707 | 11/246,706 | 11/246,705 | 11/246,708 | 11/246,693 | 11/246,692 | 11/246,696 |
| 11/246,695 | 11/246,694 | 11/482,958 | 11/482,955 | 11/482,962 | 11/482,963 | 11/482,956 |
| 11/482,954 | 11/482,974 | 11/482,957 | 11/482,987 | 11/482,959 | 11/482,960 | 11/482,961 |
| 11/482,964 | 11/482,965 | 11/482,976 | 11/482,973 | 11/495,815 | 11/495,816 | 11/495,817 |
| 12,050,078 | 12,050,066 | 10/803,074 | 10/803,073 | 7,040,823 | 10/803,076 | 10/803,077 |
| 10/803,078 | 10/803,079 | 10/922,971 | 10/922,970 | 10/922,836 | 10/922,842 | 10/922,848 |
| 10/922,843 | 7,125,185 | 7,229,226 | 7,364,378 | 11/753,559 | 12,056,276 | 76,584,733 |
| 6,227,652 | 6,213,588 | 6,213,589 | 6,231,163 | 6,247,795 | 6,394,581 | 6,244,691 |
| 6,257,704 | 6,416,168 | 6,220,694 | 6,257,705 | 6,247,794 | 6,234,610 | 6,247,793 |
| 6,264,306 | 6,241,342 | 6,247,792 | 6,264,307 | 6,254,220 | 6,234,611 | 6,302,528 |
| 6,283,582 | 6,239,821 | 6,338,547 | 6,247,796 | 6,557,977 | 6,390,603 | 6,362,843 |
| 6,293,653 | 6,312,107 | 6,227,653 | 6,234,609 | 6,238,040 | 6,188,415 | 6,227,654 |
| 6,209,989 | 6,247,791 | 6,336,710 | 6,217,153 | 6,416,167 | 6,243,113 | 6,283,581 |
| 6,247,790 | 6,260,953 | 6,267,469 | 6,588,882 | 6,742,873 | 6,918,655 | 6,547,371 |
| 6,938,989 | 6,598,964 | 6,923,526 | 6,273,544 | 6,309,048 | 6,420,196 | 6,443,558 |
| 6,439,689 | 6,378,989 | 6,848,181 | 6,634,735 | 6,299,289 | 6,299,290 | 6,425,654 |
| 6,902,255 | 6,623,101 | 6,406,129 | 6,505,916 | 6,457,809 | 6,550,895 | 6,457,812 |
| 7,152,962 | 6,428,133 | 7,216,956 | 7,080,895 | 11/144,844 | 7,182,437 | 7,357,485 |
| 11/635,533 | 11/607,976 | 11/607,975 | 11/607,999 | 11/607,980 | 11/607,979 | 11/607,978 |
| 11/735,961 | 11/685,074 | 11/696,126 | 11/696,144 | 11/696,650 | 11/763,446 | 12,043,820 |
| 6,224,780 | 6,235,212 | 6,280,643 | 6,284,147 | 6,214,244 | 6,071,750 | 6,267,905 |
| 6,251,298 | 6,258,285 | 6,225,138 | 6,241,904 | 6,299,786 | 6,866,789 | 6,231,773 |
| 6,190,931 | 6,248,249 | 6,290,862 | 6,241,906 | 6,565,762 | 6,241,905 | 6,451,216 |
| 6,231,772 | 6,274,056 | 6,290,861 | 6,248,248 | 6,306,671 | 6,331,258 | 6,110,754 |
| 6,294,101 | 6,416,679 | 6,264,849 | 6,254,793 | 6,245,246 | 6,855,264 | 6,235,211 |
| 6,491,833 | 6,264,850 | 6,258,284 | 6,312,615 | 6,228,668 | 6,180,427 | 6,171,875 |
| 6,267,904 | 6,245,247 | 6,315,914 | 7,169,316 | 6,526,658 | 7,210,767 | 11/056,146 |
| 11/635,523 | 6,665,094 | 6,450,605 | 6,512,596 | 6,654,144 | 7,125,090 | 6,687,022 |
| 7,072,076 | 7,092,125 | 7,215,443 | 7,136,195 | 7,077,494 | 6,877,834 | 6,969,139 |
| 10/636,227 | 7,283,280 | 6,912,067 | 7,277,205 | 7,154,637 | 10/636,230 | 7,070,251 |
| 6,851,782 | 10/636,211 | 10/636,247 | 6,843,545 | 7,079,286 | 7,064,867 | 7,065,247 |
| 7,027,177 | 7,218,415 | 7,064,873 | 6,954,276 | 7,061,644 | 7,092,127 | 7,059,695 |
| 10/990,382 | 7,177,052 | 7,270,394 | 11/124,231 | 7,188,921 | 7,187,469 | 7,196,820 |
| 11/281,445 | 7,283,281 | 7,251,051 | 7,245,399 | 11/524,911 | 11/640,267 | 11/730,387 |
| 7,349,125 | 7,336,397 | 11/834,637 | 11/853,019 | 11/863,239 | 12,015,485 | 12,030,797 |
| 12,050,933 | 12,106,330 | 11/305,274 | 11/305,273 | 11/305,275 | 11/305,152 | 11/305,158 |
| 11/305,008 | 6,231,148 | 6,293,658 | 6,614,560 | 6,238,033 | 6,312,070 | 6,238,111 |
| 6,378,970 | 6,196,739 | 6,270,182 | 6,152,619 | 7,006,143 | 6,876,394 | 6,738,096 |
| 6,970,186 | 6,287,028 | 6,412,993 | 11/033,145 | 11/102,845 | 11/102,861 | 11/248,421 |
| 11/672,878 | 11/454,899 | 10/407,212 | 7,252,366 | 10/683,064 | 7,360,865 | 7,275,811 |
| 10/884,889 | 10/922,890 | 7,334,874 | 10/922,885 | 10/922,889 | 10/922,884 | 10/922,879 |
| 10/922,887 | 10/922,888 | 10/922,874 | 7,234,795 | 10/922,871 | 7,328,975 | 7,293,855 |
| 10/922,882 | 10/922,883 | 10/922,878 | 10/922,872 | 7,360,871 | 10/922,886 | 10/922,877 |
| 7,147,792 | 7,175,774 | 11/159,193 | 7,350,903 | 11,766,713 | 11/841,647 | 12,018,040 |
| 12,035,410 | 12,037,054 | 12,103,711 | 11/482,980 | 11/563,684 | 11/482,967 | 11/482,966 |
| 11/482,988 | 11/482,989 | 11/293,832 | 11/293,838 | 11/293,825 | 11/293,841 | 11/293,799 |
| 11/293,796 | 11/293,797 | 11/293,798 | 11/124,158 | 11/124,196 | 11/124,199 | 11/124,162 |
| 11/124,202 | 11/124,197 | 11/124,154 | 11/124,198 | 7,284,921 | 11/124,151 | 11/124,160 |
| 11/124,192 | 11/124,175 | 11/124,163 | 11/124,149 | 7,360,880 | 11/124,173 | 11/124,155 |
| 7,236,271 | 11/124,174 | 11/124,194 | 11/124,164 | 11/124,200 | 11/124,195 | 11/124,166 |
| 11/124,150 | 11/124,172 | 11/124,165 | 11/124,186 | 11/124,185 | 11/124,184 | 11/124,182 |
| 11/124,201 | 11/124,171 | 11/124,181 | 11/124,161 | 11/124,156 | 11/124,191 | 11/124,159 |

-continued

| | | | | | | |
|---|---|---|---|---|---|---|
| 11/124,176 | 11/124,188 | 11/124,170 | 11/124,187 | 11/124,189 | 11/124,190 | 11/124,180 |
| 11/124,193 | 11/124,183 | 11/124,178 | 11/124,177 | 11/124,148 | 11/124,168 | 11/124,167 |
| 11/124,179 | 11/124,169 | 11/187,976 | 11/188,011 | 11/188,014 | 11/482,979 | 11/735,490 |
| 11/853,018 | 11/944,450 | 12,023,815 | 12,035,414 | 12,056,232 | 11/228,540 | 11/228,500 |
| 11/228,501 | 11/228,530 | 11/228,490 | 11/228,531 | 11/228,504 | 11/228,533 | 11/228,502 |
| 11/228,507 | 11/228,482 | 11/228,505 | 11/228,497 | 11/228,487 | 11/228,529 | 11/228,484 |
| 11/228,489 | 11/228,518 | 11/228,536 | 11/228,496 | 11/228,488 | 11/228,506 | 11/228,516 |
| 11/228,526 | 11/228,539 | 11/228,538 | 11/228,524 | 11/228,523 | 11/228,519 | 11/228,528 |
| 11/228,527 | 11/228,525 | 11/228,520 | 11/228,498 | 11/228,511 | 11/228,522 | 11/228,515 |
| 11/228,537 | 11/228,534 | 11/228,491 | 11/228,499 | 11/228,509 | 11/228,492 | 11/228,493 |
| 11/228,510 | 11/228,508 | 11/228,512 | 11/228,514 | 11/228,494 | 11/228,495 | 11/228,486 |
| 11/228,481 | 11/228,477 | 7,357,311 | 11/228,483 | 11/228,521 | 11/228,517 | 11/228,532 |
| 11/228,513 | 11/228,503 | 11/228,480 | 11/228,535 | 11/228,478 | 11/228,479 | 12,035,419 |
| 12,107,031 | 6,238,115 | 6,386,535 | 6,398,344 | 6,612,240 | 6,752,549 | 6,805,049 |
| 6,971,313 | 6,899,480 | 6,860,664 | 6,925,935 | 6,966,636 | 7,024,995 | 7,284,852 |
| 6,926,455 | 7,056,038 | 6,869,172 | 7,021,843 | 6,988,845 | 6,964,533 | 6,981,809 |
| 7,284,822 | 7,258,067 | 7,322,757 | 7,222,941 | 7,284,925 | 7,278,795 | 7,249,904 |
| 7,364,286 | 11/863,246 | 11/863,145 | 11/865,650 | 12,050,091 | 12,050,106 | 6,087,638 |
| 6,340,222 | 6,041,600 | 6,299,300 | 6,067,797 | 6,286,935 | 6,044,646 | 6,382,769 |
| 6,787,051 | 6,938,990 | 11/242,916 | 11/144,799 | 11/198,235 | 11,861,282 | 11,861,284 |
| 11/766,052 | 7,152,972 | 11/592,996 | D529952 | 6,390,605 | 6,322,195 | 6,612,110 |
| 6,480,089 | 6,460,778 | 6,305,788 | 6,426,014 | 6,364,453 | 6,457,795 | 6,315,399 |
| 6,338,548 | 7,040,736 | 6,938,992 | 6,994,425 | 6,863,379 | 6,540,319 | 6,994,421 |
| 6,984,019 | 7,008,043 | 6,997,544 | 6,328,431 | 6,991,310 | 10/965,772 | 7,140,723 |
| 6,328,425 | 6,982,184 | 7,267,423 | 7,134,741 | 7,066,577 | 7,152,945 | 7,303,689 |
| 7,021,744 | 6,991,320 | 7,155,911 | 11/107,799 | 6,595,624 | 7,152,943 | 7,125,103 |
| 7,328,971 | 7,290,857 | 7,285,437 | 7,229,151 | 7,341,331 | 7,237,873 | 11/329,163 |
| 11/442,180 | 11/450,431 | 7,213,907 | 6,417,757 | 11/482,951 | 11/545,566 | 11/583,826 |
| 11/604,315 | 11/604,323 | 11/643,845 | 11/706,950 | 11/730,399 | 11,749,121 | 11/753,549 |
| 11/834,630 | 11/935,389 | 11/869,670 | 7,095,309 | 11/945,169 | 11,957,473 | 11,967,235 |
| 12,017,896 | 6,854,825 | 6,623,106 | 6,672,707 | 6,575,561 | 6,817,700 | 6,588,885 |
| 7,075,677 | 6,428,139 | 6,575,549 | 6,846,692 | 6,425,971 | 7,063,993 | 6,383,833 |
| 6,955,414 | 6,412,908 | 6,746,105 | 6,953,236 | 6,412,904 | 7,128,388 | 6,398,343 |
| 6,652,071 | 6,793,323 | 6,659,590 | 6,676,245 | 7,201,460 | 6,464,332 | 6,659,593 |
| 6,478,406 | 6,978,613 | 6,439,693 | 6,502,306 | 6,966,111 | 6,863,369 | 6,428,142 |
| 6,874,868 | 6,390,591 | 6,799,828 | 6,896,358 | 7,018,016 | 10/296,534 | 6,328,417 |
| 6,322,194 | 6,382,779 | 6,629,745 | 6,565,193 | 6,609,786 | 6,609,787 | 6,439,908 |
| 6,684,503 | 6,843,551 | 6,764,166 | 6,561,617 | 7,328,967 | 6,557,970 | 6,546,628 |
| 10/510,098 | 6,652,074 | 6,820,968 | 7,175,260 | 6,682,174 | 7,303,262 | 6,648,453 |
| 6,834,932 | 6,682,176 | 6,998,062 | 6,767,077 | 7,278,717 | 6,755,509 | 7,347,537 |
| 6,692,108 | 10/534,811 | 6,672,709 | 7,303,263 | 7,086,718 | 10/534,881 | 6,672,710 |
| 10/534,812 | 6,669,334 | 7,322,686 | 7,152,958 | 7,281,782 | 6,824,246 | 7,264,336 |
| 6,669,333 | 7,357,489 | 6,820,967 | 7,306,326 | 6,736,489 | 7,264,335 | 6,719,406 |
| 7,222,943 | 7,188,419 | 7,168,166 | 6,974,209 | 7,086,719 | 6,974,210 | 7,195,338 |
| 7,252,775 | 7,101,025 | 11/474,281 | 11/485,258 | 11/706,304 | 11/706,324 | 11/706,326 |
| 11/706,321 | 11/772,239 | 11/782,598 | 11/829,941 | 11/852,991 | 11,852,986 | 11/936,062 |
| 11/934,027 | 11,955,028 | 12,034,578 | 12,036,908 | 11/763,440 | 11/763,442 | 11/246,687 |
| 11/246,718 | 7,322,681 | 11/246,686 | 11/246,703 | 11/246,691 | 11/246,711 | 11/246,690 |
| 11/246,712 | 11/246,717 | 11/246,709 | 11/246,700 | 11/246,701 | 11/246,702 | 11/246,668 |
| 11/246,697 | 11/246,698 | 11/246,699 | 11/246,675 | 11/246,674 | 11/246,667 | 11/829,957 |
| 11/829,960 | 11/829,961 | 11/829,962 | 11/829,963 | 11/829,966 | 11/829,967 | 11/829,968 |
| 11/829,969 | 11,946,839 | 11,946,838 | 11,946,837 | 11,951,230 | 7,156,508 | 7,159,972 |
| 7,083,271 | 7,165,834 | 7,080,894 | 7,201,469 | 7,090,336 | 7,156,489 | 10/760,233 |
| 10/760,246 | 7,083,257 | 7,258,422 | 7,255,423 | 7,219,980 | 10/760,253 | 10/760,255 |
| 10/760,209 | 7,118,192 | 10/760,194 | 7,322,672 | 7,077,505 | 7,198,354 | 7,077,504 |
| 10/760,189 | 7,198,355 | 10/760,232 | 7,322,676 | 7,152,959 | 7,213,906 | 7,178,901 |
| 7,222,938 | 7,108,353 | 7,104,629 | 11/446,227 | 11/454,904 | 11/472,345 | 11/474,273 |
| 7,261,401 | 11/474,279 | 11/482,939 | 7,328,972 | 7,322,673 | 7,306,324 | 7,306,325 |
| 11/603,824 | 11/601,756 | 11/601,672 | 7,303,261 | 11/653,253 | 11/706,328 | 11/706,299 |
| 11/706,965 | 11/737,080 | 11/737,041 | 11/778,062 | 11/778,566 | 11/782,593 | 11/934,018 |
| 11/945,157 | 11,951,095 | 11,951,828 | 11,954,906 | 11,954,949 | 11,967,226 | 12,101,152 |
| 7,303,930 | 11/246,672 | 11/246,673 | 11/246,683 | 11/246,682 | 11,860,538 | 11,860,539 |
| 11/860,540 | 11,860,541 | 11,860,542 | 11/936,060 | 11,877,667 | 11,877,668 | 12,046,451 |
| 12,046,452 | 12,046,453 | 12,046,454 | 7,246,886 | 7,128,400 | 7,108,355 | 6,991,322 |
| 7,287,836 | 7,118,197 | 10/728,784 | 7,364,269 | 7,077,493 | 6,962,402 | 10/728,803 |
| 7,147,308 | 10/728,779 | 7,118,198 | 7,168,790 | 7,172,270 | 7,229,155 | 6,830,318 |
| 7,195,342 | 7,175,261 | 10/773,183 | 7,108,356 | 7,118,202 | 10/773,186 | 7,134,744 |
| 10/773,185 | 7,134,743 | 7,182,439 | 7,210,768 | 10/773,187 | 7,134,745 | 7,156,484 |
| 7,118,201 | 7,111,926 | 10/773,184 | 7,018,021 | 11/060,751 | 11/060,805 | 11/188,017 |
| 7,128,402 | 11/298,774 | 11/329,157 | 11/490,041 | 11/501,767 | 7,284,839 | 7,246,885 |
| 7,229,156 | 11/505,846 | 11/505,857 | 7,293,858 | 11/524,908 | 11/524,938 | 7,258,427 |
| 11/524,912 | 7,278,716 | 11/592,995 | 11/603,825 | 11/649,773 | 11/650,549 | 11/653,237 |
| 11/706,378 | 11/706,962 | 11,749,118 | 11/754,937 | 11,749,120 | 11/744,885 | 11/779,850 |
| 11/765,439 | 11/842,950 | 11/839,539 | 11/926,121 | 12,025,621 | 11/097,308 | 11/097,309 |
| 7,246,876 | 11/097,299 | 11/097,310 | 11/097,213 | 7,328,978 | 7,334,876 | 7,147,306 |
| 7,261,394 | 11/764,806 | 11/782,595 | 11,965,696 | 12/027,286 | 12,103,706 | 11/482,953 |
| 11/482,977 | 11/544,778 | 11/544,779 | 12,056,149 | 11/764,808 | 11/756,628 | 09/575,197 |
| 7,079,712 | 6,825,945 | 7,330,974 | 6,813,039 | 6,987,506 | 7,038,797 | 6,980,318 |
| 6,816,274 | 7,102,772 | 7,350,236 | 6,681,045 | 6,728,000 | 7,173,722 | 7,088,459 |
| 09/575,181 | 11/329,187 | 11/491,225 | 11/491,121 | 11/454,902 | 12,101,125 | 7,068,382 |

-continued

| | | | | | | |
|---|---|---|---|---|---|---|
| 7,062,651 | 6,789,194 | 6,789,191 | 6,644,642 | 6,502,614 | 6,622,999 | 6,669,385 |
| 6,549,935 | 6,987,573 | 6,727,996 | 6,591,884 | 6,439,706 | 6,760,119 | 7,295,332 |
| 6,290,349 | 6,428,155 | 6,785,016 | 11/206,756 | 6,870,966 | 6,822,639 | 6,737,591 |
| 11,866,336 | 7,055,739 | 7,233,320 | 6,830,196 | 6,832,717 | 6,957,768 | 09/575,172 |
| 7,170,499 | 7,106,888 | 7,123,239 | 6,593,166 | 7,132,679 | 6,940,088 | 7,119,357 |
| 7,307,272 | 6,755,513 | 6,974,204 | 6,409,323 | 7,055,930 | 6,281,912 | 6,893,109 |
| 6,604,810 | 6,824,242 | 6,318,920 | 7,210,867 | 6,488,422 | 6,655,786 | 6,457,810 |
| 6,485,135 | 6,796,731 | 6,904,678 | 6,641,253 | 7,125,106 | 6,786,658 | 7,097,273 |
| 6,824,245 | 7,222,947 | 6,918,649 | 6,860,581 | 6,929,351 | 7,063,404 | 6,969,150 |
| 7,004,652 | 6,871,938 | 6,905,194 | 6,846,059 | 6,997,626 | 7,303,256 | 7,029,098 |
| 6,966,625 | 7,114,794 | 7,207,646 | 7,077,496 | 7,284,831 | 7,357,484 | 7,152,938 |
| 7,182,434 | 7,182,430 | 7,306,317 | 7,032,993 | 7,325,905 | 11/155,545 | 7,357,475 |
| 7,172,266 | 7,258,430 | 7,128,392 | 7,210,866 | 7,306,322 | 11/505,933 | 11/540,727 |
| 11/635,480 | 7,354,208 | 11/706,303 | 11/709,084 | 7,357,583 | 11/744,143 | 11/779,845 |
| 11/782,589 | 11/863,256 | 11/940,302 | 11/940,235 | 11,955,359 | 12,019,583 | 12,019,566 |
| 12,036,910 | 12,043,795 | 11/066,161 | 7,341,330 | 11/066,159 | 11/066,158 | 7,287,831 |
| 11/875,936 | 12,017,818 | 12,101,154 | 6,804,030 | 6,807,315 | 6,771,811 | 6,683,996 |
| 7,271,936 | 7,304,771 | 6,965,691 | 7,058,219 | 7,289,681 | 7,187,807 | 7,181,063 |
| 7,366,351 | 11/603,823 | 7,349,572 | 12,025,633 | 10/727,181 | 10/727,162 | 10/727,163 |
| 10/727,245 | 7,121,639 | 7,165,824 | 7,152,942 | 10/727,157 | 7,181,572 | 7,096,137 |
| 7,302,592 | 7,278,034 | 7,188,282 | 10/727,159 | 10/727,180 | 10/727,179 | 10/727,192 |
| 10/727,274 | 10/727,164 | 10/727,161 | 10/727,198 | 10/727,158 | 10/754,536 | 10/754,938 |
| 10/727,160 | 10/934,720 | 7,171,323 | 7,278,697 | 11/442,131 | 7,360,131 | 11/488,853 |
| 7,328,115 | 11,749,750 | 11,749,749 | 11,955,127 | 11,951,213 | 12,050,941 | 12,043,844 |
| 12/047,315 | 10/296,522 | 6,795,215 | 7,070,098 | 7,154,638 | 6,805,419 | 6,859,289 |
| 6,977,751 | 6,398,332 | 6,394,573 | 6,622,923 | 6,747,760 | 6,921,144 | 10/884,881 |
| 7,092,112 | 7,192,106 | 11/039,866 | 7,173,739 | 6,986,560 | 7,008,033 | 11/148,237 |
| 7,222,780 | 7,270,391 | 7,150,510 | 11/478,599 | 11/499,749 | 11/521,388 | 11/738,518 |
| 12,062,455 | 12,062,481 | 11/482,981 | 11/743,662 | 11/743,661 | 11/743,659 | 11/743,655 |
| 11/752,900 | 11,926,109 | 11/927,163 | 11,929,567 | 7,195,328 | 7,182,422 | 11/650,537 |
| 11/712,540 | 10/854,521 | 10/854,522 | 10/854,488 | 7,281,330 | 10/854,503 | 7,328,956 |
| 10/854,509 | 7,188,928 | 7,093,989 | 10/854,497 | 10/854,495 | 10/854,498 | 10/854,511 |
| 10/854,512 | 10/854,525 | 10/854,526 | 10/854,516 | 7,252,353 | 10/854,515 | 7,267,417 |
| 10/854,505 | 10/854,493 | 7,275,805 | 7,314,261 | 10/854,490 | 7,281,777 | 7,290,852 |
| 10/854,528 | 10/854,523 | 10/854,527 | 10/854,524 | 10/854,520 | 10/854,514 | 10/854,519 |
| 10/854,513 | 10/854,499 | 10/854,501 | 7,266,661 | 7,243,193 | 10/854,518 | 10/854,517 |
| 10/934,628 | 7,163,345 | 7,322,666 | 11/601,757 | 11/706,295 | 11/735,881 | 11,748,483 |
| 11,749,123 | 11/766,061 | 11,775,135 | 11,772,235 | 11/778,569 | 11/829,942 | 11/870,342 |
| 11/935,274 | 11/937,239 | 11,961,907 | 11,961,940 | 11,961,961 | 12,055,314 | 11/014,731 |
| 6,924,907 | 6,712,452 | 6,416,160 | 6,238,043 | 6,958,826 | 6,812,972 | 6,553,459 |
| 6,967,741 | 6,956,669 | 6,903,766 | 6,804,026 | 7,259,889 | 6,975,429 | 10/636,234 |
| 10/636,233 | 7,301,567 | 10/636,216 | 7,274,485 | 7,139,084 | 7,173,735 | 7,068,394 |
| 7,286,182 | 7,086,644 | 7,250,977 | 7,146,281 | 7,023,567 | 7,136,183 | 7,083,254 |
| 6,796,651 | 7,061,643 | 7,057,758 | 6,894,810 | 6,995,871 | 7,085,010 | 7,092,126 |
| 7,123,382 | 7,061,650 | 10/853,143 | 6,986,573 | 6,974,212 | 7,307,756 | 7,173,737 |
| 10/954,168 | 7,246,868 | 11/065,357 | 7,137,699 | 11/107,798 | 7,148,994 | 7,077,497 |
| 11/176,372 | 7,248,376 | 11/225,158 | 7,306,321 | 7,173,729 | 11/442,132 | 11/478,607 |
| 11/503,085 | 11/545,502 | 11/583,943 | 11/585,946 | 11/653,239 | 11/653,238 | 11/764,781 |
| 11/764,782 | 11/779,884 | 11,845,666 | 11/872,637 | 11/944,401 | 11/940,215 | 12,106,331 |
| 11/544,764 | 11/544,765 | 11/544,772 | 11/544,773 | 11/544,774 | 11/544,775 | 11/544,776 |
| 11/544,766 | 11/544,767 | 11/544,771 | 11/544,770 | 11/544,769 | 11/544,777 | 11/544,768 |
| 11/544,763 | 11/293,804 | 11/293,840 | 11/293,803 | 11/293,833 | 11/293,834 | 11/293,835 |
| 11/293,836 | 11/293,837 | 11/293,792 | 11/293,794 | 11/293,839 | 11/293,826 | 11/293,829 |
| 11/293,830 | 11/293,827 | 11/293,828 | 7,270,494 | 11/293,823 | 11/293,824 | 11/293,831 |
| 11/293,815 | 11/293,819 | 11/293,818 | 11/293,817 | 11/293,816 | 11/838,875 | 11/482,978 |
| 11/640,356 | 11/640,357 | 11/640,358 | 11/640,359 | 11/640,360 | 11/640,355 | 11/679,786 |
| 11/872,714 | 10/760,254 | 10/760,210 | 7,364,263 | 7,201,468 | 7,360,868 | 10/760,249 |
| 7,234,802 | 7,303,255 | 7,287,846 | 7,156,511 | 10/760,264 | 7,258,432 | 7,097,291 |
| 10/760,222 | 10/760,248 | 7,083,273 | 10/760,192 | 10/760,203 | 10/760,204 | 10/760,205 |
| 10/760,206 | 10/760,267 | 10/760,270 | 7,198,352 | 7,364,264 | 7,303,251 | 7,201,470 |
| 7,121,655 | 7,293,861 | 7,232,208 | 7,328,985 | 7,344,232 | 7,083,272 | 7,261,400 |
| 11/474,272 | 11/474,315 | 7,311,387 | 11/583,874 | 7,303,258 | 11/706,322 | 11/706,968 |
| 11/749,119 | 11,749,157 | 11,779,848 | 11/782,590 | 11/855,152 | 11,855,151 | 11/870,327 |
| 11/934,780 | 11/935,992 | 11,951,193 | 12/017,327 | 12,015,273 | 12,036,882 | 12,050,164 |
| 12,050,166 | 12,062,502 | 12,103,710 | 11/014,764 | 11/014,763 | 7,331,663 | 7,360,861 |
| 7,328,973 | 11/014,760 | 11/014,757 | 7,303,252 | 7,249,822 | 11/014,762 | 7,311,382 |
| 7,360,860 | 7,364,257 | 11/014,736 | 7,350,896 | 11/014,758 | 11/014,725 | 7,331,660 |
| 11/014,738 | 11/014,737 | 7,322,684 | 7,322,685 | 7,311,381 | 7,270,405 | 7,303,268 |
| 11/014,735 | 11/014,734 | 11/014,719 | 11/014,750 | 11/014,749 | 7,249,833 | 11/758,640 |
| 11/775,143 | 11/838,877 | 11,944,453 | 11/944,633 | 11,955,065 | 12/003,875 | 12/003,952 |
| 12,007,818 | 12,007,817 | 12,068,679 | 12,071,187 | 12,076,666 | 12,076,665 | 12,076,664 |
| 12,079,897 | 11/014,769 | 11/014,729 | 7,331,661 | 11/014,733 | 7,300,140 | 7,357,492 |
| 7,357,493 | 11/014,766 | 11/014,740 | 7,284,816 | 7,284,845 | 7,255,430 | 11/014,744 |
| 7,328,984 | 7,350,913 | 7,322,671 | 11/014,718 | 11/014,717 | 11/014,716 | 11/014,732 |
| 7,347,534 | 11/097,268 | 11/097,185 | 11/097,184 | 11/778,567 | 11,852,958 | 11,852,907 |
| 11/872,038 | 11,955,093 | 11,961,578 | 12,022,023 | 12,023,000 | 12,023,018 | 12,031,582 |
| 12,043,708 | 12,101,150 | 11/293,820 | 11/293,813 | 11/293,822 | 11/293,812 | 7,357,496 |
| 11/293,814 | 11/293,793 | 11/293,842 | 11/293,811 | 11/293,807 | 11/293,806 | 11/293,805 |
| 11/293,810 | 12,050,021 | 11/688,863 | 11/688,864 | 11/688,865 | 7,364,265 | 11/688,867 |
| 11/688,868 | 11/688,869 | 11/688,871 | 11/688,872 | 11/688,873 | 11/741,766 | 12,014,767 |

-continued

| | | | | | | |
|---|---|---|---|---|---|---|
| 12,014,768 | 12,014,769 | 12,014,770 | 12,014,771 | 12,014,772 | 12,014,773 | 12,014,774 |
| 12,014,775 | 12,014,776 | 12,014,777 | 12,014,778 | 12,014,779 | 12,014,780 | 12,014,781 |
| 12,014,782 | 12,014,783 | 12,014,784 | 12,014,785 | 12,014,787 | 12,014,788 | 12,014,789 |
| 12,014,790 | 12,014,791 | 12,014,792 | 12,014,793 | 12,014,794 | 12,014,796 | 12,014,798 |
| 12,014,801 | 12,014,803 | 12,014,804 | 12,014,805 | 12,014,806 | 12,014,807 | 12,049,371 |
| 12,049,372 | 12,049,373 | 12,049,374 | 12,049,375 | 12,103,674 | 11/482,982 | 11/482,983 |
| 11/482,984 | 11/495,818 | 11/495,819 | 11/677,049 | 11/677,050 | 11/677,051 | 11,872,719 |
| 11,872,718 | 12,046,449 | 12,062,514 | 12,062,517 | 12,062,518 | 12,062,520 | 12,062,521 |
| 12,062,522 | 12,062,523 | 12,062,524 | 12,062,525 | 12,062,526 | 12,062,527 | 12,062,528 |
| 12,062,529 | 12,062,530 | 12,062,531 | 7,306,320 | 11/934,781 | D528156 | 10/760,180 |
| 7,111,935 | 10/760,213 | 10/760,219 | 10/760,237 | 7,261,482 | 10/760,220 | 7,002,664 |
| 10/760,252 | 10/760,265 | 7,088,420 | 11/446,233 | 11/503,083 | 11/503,081 | 11/516,487 |
| 11/599,312 | 6,364,451 | 6,533,390 | 6,454,378 | 7,224,478 | 6,559,969 | 6,896,362 |
| 7,057,760 | 6,982,799 | 11/202,107 | 11/743,672 | 11,744,126 | 11/743,673 | 7,093,494 |
| 7,143,652 | 7,089,797 | 7,159,467 | 7,234,357 | 7,124,643 | 7,121,145 | 7,089,790 |
| 7,194,901 | 6,968,744 | 7,089,798 | 7,240,560 | 7,137,302 | 7,350,417 | 7,171,855 |
| 7,260,995 | 7,260,993 | 7,165,460 | 7,222,538 | 7,258,019 | 11/543,047 | 7,258,020 |
| 11/604,324 | 7,334,480 | 11/706,305 | 11/707,056 | 11/744,211 | 11/767,526 | 11/779,846 |
| 11/764,227 | 11/829,943 | 11/829,944 | 12,015,390 | 12,031,475 | 12,056,274 | 11/014,728 |
| 11/014,727 | 12,062,512 | D536031 | D531214 | 7,237,888 | 7,168,654 | 7,201,272 |
| 6,991,098 | 7,217,051 | 6,944,970 | 10/760,215 | 7,108,434 | 10/760,257 | 7,210,407 |
| 7,186,042 | 10/760,266 | 6,920,704 | 7,217,049 | 10/760,214 | 10/760,260 | 7,147,102 |
| 7,287,828 | 7,249,838 | 10/760,241 | 10/962,413 | 10/962,427 | 7,261,477 | 7,225,739 |
| 10/962,402 | 10/962,425 | 10/962,428 | 7,191,978 | 10/962,426 | 10/962,409 | 10/962,417 |
| 10/962,403 | 7,163,287 | 7,258,415 | 7,322,677 | 7,258,424 | 10/962,410 | 7,195,412 |
| 7,207,670 | 7,270,401 | 7,220,072 | 11/474,267 | 11/544,547 | 11/585,925 | 11/593,000 |
| 11/706,298 | 11/706,296 | 11/706,327 | 11/730,760 | 11/730,407 | 11/730,787 | 11/735,977 |
| 11/736,527 | 11/753,566 | 11/754,359 | 11/778,061 | 11/765,398 | 11/778,556 | 11/829,937 |
| 11/780,470 | 11/866,399 | 12,050,157 | 11/223,262 | 11/223,018 | 11/223,114 | 11,955,366 |
| 7,322,761 | 11/223,021 | 11/223,020 | 11/223,019 | 11/014,730 | 29/279,123 | 6,716,666 |
| 6,949,217 | 6,750,083 | 7,014,451 | 6,777,259 | 6,923,524 | 6,557,978 | 6,991,207 |
| 6,766,998 | 6,967,354 | 6,759,723 | 6,870,259 | 10/853,270 | 6,925,875 | 10/898,214 |
| 7,095,109 | 7,145,696 | 10/976,081 | 7,193,482 | 7,134,739 | 7,222,939 | 7,164,501 |
| 7,118,186 | 7,201,523 | 7,226,159 | 7,249,839 | 7,108,343 | 7,154,626 | 7,079,292 |
| 10/980,184 | 7,233,421 | 7,063,408 | 10/983,082 | 10/982,804 | 7,032,996 | 10/982,834 |
| 10/982,833 | 7,349,216 | 7,217,046 | 6,948,870 | 7,195,336 | 7,070,257 | 10/986,813 |
| 10/986,785 | 7,093,922 | 6,988,789 | 10/986,788 | 7,246,871 | 10/992,748 | 10/992,747 |
| 7,187,468 | 10/992,828 | 7,196,814 | 10/992,754 | 7,268,911 | 7,265,869 | 7,128,384 |
| 7,164,505 | 7,284,805 | 7,025,434 | 7,298,519 | 7,280,244 | 7,206,098 | 7,265,877 |
| 7,193,743 | 7,168,777 | 11/006,734 | 7,195,329 | 7,198,346 | 7,281,786 | 11/013,363 |
| 11/013,881 | 6,959,983 | 7,128,386 | 7,097,104 | 7,350,889 | 7,083,261 | 7,070,258 |
| 7,083,275 | 7,110,139 | 6,994,419 | 6,935,725 | 11/026,046 | 7,178,892 | 7,219,429 |
| 6,988,784 | 11/026,135 | 7,289,156 | 11/064,005 | 7,284,976 | 7,178,903 | 7,273,274 |
| 7,083,256 | 7,325,986 | 7,278,707 | 7,325,918 | 6,974,206 | 7,364,258 | 7,066,588 |
| 7,222,940 | 11/075,918 | 7,018,025 | 7,221,867 | 7,290,863 | 7,188,938 | 7,021,742 |
| 7,083,262 | 7,192,119 | 11/083,021 | 7,036,912 | 7,175,256 | 7,182,441 | 7,083,258 |
| 7,114,796 | 7,147,302 | 11/084,757 | 7,219,982 | 7,118,195 | 7,229,153 | 6,991,318 |
| 7,108,346 | 11/248,429 | 11/239,031 | 7,178,899 | 7,066,579 | 11/281,419 | 11,298,633 |
| 11/329,188 | 11/329,140 | 7,270,397 | 7,258,425 | 7,237,874 | 7,152,961 | 7,333,235 |
| 7,207,658 | 11/484,744 | 7,311,257 | 7,207,659 | 11/525,857 | 11/540,569 | 11/583,869 |
| 11/592,985 | 11/585,947 | 7,306,307 | 11/604,316 | 11/604,309 | 11/604,303 | 11/643,844 |
| 7,329,061 | 11/655,940 | 11/653,320 | 7,278,713 | 11/706,381 | 11/706,323 | 11/706,963 |
| 11/713,660 | 7,290,853 | 11/696,186 | 11/730,390 | 11/737,139 | 11/737,749 | 11/740,273 |
| 11,749,122 | 11/754,361 | 11,766,043 | 11/764,775 | 11/768,872 | 11/775,156 | 11/779,271 |
| 11/779,272 | 11/829,938 | 11/839,502 | 11,858,852 | 11/862,188 | 11,859,790 | 11/872,618 |
| 11/923,651 | 11,950,255 | 11,930,001 | 11,955,362 | 12,015,368 | 11,965,718 | 12,049,975 |
| 12,050,946 | 12,103,709 | 6,485,123 | 6,425,657 | 6,488,358 | 7,021,746 | 6,712,986 |
| 6,981,757 | 6,505,912 | 6,439,694 | 6,364,461 | 6,378,990 | 6,425,658 | 6,488,361 |
| 6,814,429 | 6,471,336 | 6,457,813 | 6,540,331 | 6,454,396 | 6,464,325 | 6,443,559 |
| 6,435,664 | 6,412,914 | 6,488,360 | 6,550,896 | 6,439,695 | 6,447,100 | 09/900,160 |
| 6,488,359 | 6,637,873 | 10/485,738 | 6,618,117 | 10/485,737 | 6,803,989 | 7,234,801 |
| 7,044,589 | 7,163,273 | 6,416,154 | 6,547,364 | 10/485,744 | 6,644,771 | 7,152,939 |
| 6,565,181 | 7,325,897 | 6,857,719 | 7,255,414 | 6,702,417 | 7,284,843 | 6,918,654 |
| 7,070,265 | 6,616,271 | 6,652,078 | 6,503,408 | 6,607,263 | 7,111,924 | 6,623,108 |
| 6,698,867 | 6,488,362 | 6,625,874 | 6,921,153 | 7,198,356 | 6,536,874 | 6,425,651 |
| 6,435,667 | 10/509,997 | 6,527,374 | 7,334,873 | 6,582,059 | 10/510,152 | 6,513,908 |
| 7,246,883 | 6,540,332 | 6,547,368 | 7,070,256 | 6,508,546 | 10/510,151 | 6,679,584 |
| 7,303,254 | 6,857,724 | 10/509,998 | 6,652,052 | 10/509,999 | 6,672,706 | 10/510,096 |
| 6,688,719 | 6,712,924 | 6,588,886 | 7,077,508 | 7,207,654 | 6,935,724 | 6,927,786 |
| 6,988,787 | 6,899,415 | 6,672,708 | 6,644,767 | 6,874,866 | 6,830,316 | 6,994,420 |
| 6,954,254 | 7,086,720 | 7,240,992 | 7,267,424 | 7,128,397 | 7,084,951 | 7,156,496 |
| 7,066,578 | 7,101,023 | 11/165,027 | 11/202,235 | 11/225,157 | 7,159,965 | 7,255,424 |
| 11/349,519 | 7,137,686 | 7,201,472 | 7,287,829 | 11/504,602 | 7,216,957 | 11/520,572 |
| 11/583,858 | 11/583,895 | 11/585,976 | 11/635,488 | 7,278,712 | 11/706,952 | 11/706,307 |
| 7,287,827 | 11,944,451 | 11/740,287 | 7,364,271 | 11/758,643 | 11/778,572 | 11,859,791 |
| 11/863,260 | 11/874,178 | 11/936,064 | 11,951,983 | 12,015,483 | 12,050,938 | 6,916,082 |
| 6,786,570 | 10/753,478 | 6,848,780 | 6,966,633 | 7,179,395 | 6,969,153 | 6,979,075 |
| 7,132,056 | 6,832,828 | 6,860,590 | 6,905,620 | 6,786,574 | 6,824,252 | 7,097,282 |
| 6,997,545 | 6,971,734 | 6,918,652 | 6,978,990 | 6,863,105 | 10/780,624 | 7,194,629 |
| 10/791,792 | 6,890,059 | 6,988,785 | 6,830,315 | 7,246,881 | 7,125,102 | 7,028,474 |

-continued

| | | | | | | |
|---|---|---|---|---|---|---|
| 7,066,575 | 6,986,202 | 7,044,584 | 7,210,762 | 7,032,992 | 7,140,720 | 7,207,656 |
| 7,285,170 | 11/048,748 | 7,008,041 | 7,011,390 | 7,048,868 | 7,014,785 | 7,131,717 |
| 7,284,826 | 7,331,101 | 7,182,436 | 7,104,631 | 7,240,993 | 7,290,859 | 11/202,217 |
| 7,172,265 | 7,284,837 | 7,066,573 | 7,364,270 | 7,152,949 | 7,334,877 | 11/442,133 |
| 7,326,357 | 7,156,492 | 11/478,588 | 7,331,653 | 7,287,834 | 11/525,861 | 11/583,939 |
| 11/545,504 | 7,284,326 | 11/635,485 | 11/730,391 | 11/730,788 | 11/749,148 | 11/749,149 |
| 11/749,152 | 11/749,151 | 11/759,886 | 11/865,668 | 11/874,168 | 11/874,203 | 11,971,182 |
| 12,021,086 | 12,015,441 | 11,965,722 | 6,824,257 | 7,270,475 | 6,971,811 | 6,878,564 |
| 6,921,145 | 6,890,052 | 7,021,747 | 6,929,345 | 6,811,242 | 6,916,087 | 6,905,195 |
| 6,899,416 | 6,883,906 | 6,955,428 | 7,284,834 | 6,932,459 | 6,962,410 | 7,033,008 |
| 6,962,409 | 7,013,641 | 7,204,580 | 7,032,997 | 6,998,278 | 7,004,563 | 6,910,755 |
| 6,969,142 | 6,938,994 | 7,188,935 | 10/959,049 | 7,134,740 | 6,997,537 | 7,004,567 |
| 6,916,091 | 7,077,588 | 6,918,707 | 6,923,583 | 6,953,295 | 6,921,221 | 7,001,008 |
| 7,168,167 | 7,210,759 | 7,337,532 | 7,331,659 | 7,322,680 | 6,988,790 | 7,192,120 |
| 7,168,789 | 7,004,577 | 7,052,120 | 11/123,007 | 6,994,426 | 7,258,418 | 7,014,298 |
| 7,328,977 | 11/177,394 | 7,152,955 | 7,097,292 | 7,207,657 | 7,152,944 | 7,147,303 |
| 7,338,147 | 7,134,608 | 7,264,333 | 7,093,921 | 7,077,590 | 7,147,297 | 11,239,029 |
| 11/248,832 | 11/248,428 | 11/248,434 | 7,077,507 | 7,172,672 | 7,175,776 | 7,086,717 |
| 7,101,020 | 7,347,535 | 7,201,466 | 11/330,057 | 7,152,967 | 7,182,431 | 7,210,666 |
| 7,252,367 | 7,287,837 | 11/485,255 | 11/525,860 | 6,945,630 | 7,018,294 | 6,910,014 |
| 6,659,447 | 6,648,321 | 7,082,980 | 6,672,584 | 7,073,551 | 6,830,395 | 7,289,727 |
| 7,001,011 | 6,880,922 | 6,886,915 | 6,644,787 | 6,641,255 | 7,066,580 | 6,652,082 |
| 7,284,833 | 6,666,544 | 6,666,543 | 6,669,332 | 6,984,023 | 6,733,104 | 6,644,793 |
| 6,723,575 | 6,953,235 | 6,663,225 | 7,076,872 | 7,059,706 | 7,185,971 | 7,090,335 |
| 6,854,827 | 6,793,974 | 10/636,258 | 7,222,929 | 6,739,701 | 7,073,881 | 7,155,823 |
| 7,219,427 | 7,008,503 | 6,783,216 | 6,883,890 | 6,857,726 | 7,347,952 | 6,641,256 |
| 6,808,253 | 6,827,428 | 6,802,587 | 6,997,534 | 6,959,982 | 6,959,981 | 6,886,917 |
| 6,969,473 | 6,827,425 | 7,007,859 | 6,802,594 | 6,792,754 | 6,860,107 | 6,786,043 |
| 6,863,378 | 7,052,114 | 7,001,007 | 10/729,151 | 10/729,157 | 6,948,794 | 6,805,435 |
| 6,733,116 | 10/683,006 | 7,008,046 | 6,880,918 | 7,066,574 | 6,983,595 | 6,923,527 |
| 7,275,800 | 7,163,276 | 7,156,495 | 6,976,751 | 6,994,430 | 7,014,296 | 7,059,704 |
| 7,160,743 | 7,175,775 | 7,287,839 | 7,097,283 | 7,140,722 | 11/123,009 | 11/123,008 |
| 7,080,893 | 7,093,920 | 7,270,492 | 7,128,093 | 7,052,113 | 7,055,934 | 11/155,627 |
| 7,278,796 | 11/159,197 | 7,083,263 | 7,145,592 | 7,025,436 | 11/281,444 | 7,258,421 |
| 11/478,591 | 7,332,051 | 7,226,147 | 11/482,940 | 7,195,339 | 11/503,061 | 11/505,938 |
| 7,284,838 | 7,293,856 | 11,544,577 | 11/540,576 | 7,325,901 | 11/592,991 | 11/599,342 |
| 11/600,803 | 11/604,321 | 11/604,302 | 11/635,535 | 11/635,486 | 11/643,842 | 7,347,536 |
| 11/650,541 | 11/706,301 | 11/707,039 | 11/730,388 | 11/730,786 | 11/730,785 | 11/739,080 |
| 7,322,679 | 11/768,875 | 11/779,847 | 11/829,940 | 11,847,240 | 11/834,625 | 11/863,210 |
| 11/865,680 | 11/874,156 | 11/923,602 | 11,951,940 | 11,954,988 | 11,961,662 | 12,015,178 |
| 12,015,157 | 12/017,305 | 12,017,926 | 12,015,261 | 12,025,605 | 12,049,961 | 12,031,646 |
| 12,062,505 | 12,101,147 | 12,103,708 | 12,103,707 | 7,067,067 | 6,776,476 | 6,880,914 |
| 7,086,709 | 6,783,217 | 7,147,791 | 6,929,352 | 7,144,095 | 6,820,974 | 6,918,647 |
| 6,984,016 | 7,192,125 | 6,824,251 | 6,834,939 | 6,840,600 | 6,786,573 | 7,144,519 |
| 6,799,835 | 6,959,975 | 6,959,974 | 7,021,740 | 6,935,718 | 6,938,983 | 6,938,991 |
| 7,226,145 | 7,140,719 | 6,988,788 | 7,022,250 | 6,929,350 | 7,011,393 | 7,004,566 |
| 7,175,097 | 6,948,799 | 7,143,944 | 7,310,157 | 7,029,100 | 6,957,811 | 7,073,724 |
| 7,055,933 | 7,077,490 | 7,055,940 | 10/991,402 | 7,234,645 | 7,032,999 | 7,066,576 |
| 7,229,150 | 7,086,728 | 7,246,879 | 7,284,825 | 7,140,718 | 7,284,817 | 7,144,098 |
| 7,044,577 | 7,284,824 | 7,284,827 | 7,189,334 | 7,055,935 | 7,152,860 | 11/203,188 |
| 11/203,173 | 7,334,868 | 7,213,989 | 7,341,336 | 7,364,377 | 7,300,141 | 7,114,868 |
| 7,168,796 | 7,159,967 | 7,328,966 | 7,152,805 | 11/298,530 | 11/330,061 | 7,133,799 |
| 11/330,054 | 11/329,284 | 7,152,956 | 7,128,399 | 7,147,305 | 7,287,702 | 7,325,904 |
| 7,246,884 | 7,152,960 | 11/442,125 | 11/454,901 | 11/442,134 | 11/450,441 | 11/474,274 |
| 11/499,741 | 7,270,399 | 6,857,728 | 6,857,729 | 6,857,730 | 6,989,292 | 7,126,216 |
| 6,977,189 | 6,982,189 | 7,173,332 | 7,026,176 | 6,979,599 | 6,812,062 | 6,886,751 |
| 10/804,057 | 10/804,036 | 7,001,793 | 6,866,369 | 6,946,743 | 7,322,675 | 6,886,918 |
| 7,059,720 | 7,306,305 | 7,350,887 | 7,334,855 | 7,360,850 | 7,347,517 | 6,951,390 |
| 6,981,765 | 6,789,881 | 6,802,592 | 7,029,097 | 6,799,836 | 7,048,352 | 7,182,267 |
| 7,025,279 | 6,857,571 | 6,817,539 | 6,830,198 | 6,992,791 | 7,038,809 | 6,980,323 |
| 7,148,992 | 7,139,091 | 6,947,173 | 7,101,034 | 6,969,144 | 6,942,319 | 6,827,427 |
| 6,984,021 | 6,984,022 | 6,869,167 | 6,918,542 | 7,007,852 | 6,899,420 | 6,918,665 |
| 6,997,625 | 6,988,840 | 6,984,080 | 6,845,978 | 6,848,687 | 6,840,512 | 6,863,365 |
| 7,204,582 | 6,921,150 | 7,128,396 | 6,913,347 | 7,008,819 | 6,935,736 | 6,991,317 |
| 7,284,836 | 7,055,947 | 7,093,928 | 7,100,834 | 7,270,396 | 7,187,086 | 7,290,856 |
| 7,032,825 | 7,086,721 | 7,159,968 | 7,010,456 | 7,147,307 | 7,111,925 | 7,334,867 |
| 7,229,154 | 11/505,849 | 11/520,570 | 7,328,994 | 7,341,672 | 11/540,575 | 11/583,937 |
| 7,278,711 | 7,290,720 | 7,314,266 | 11/635,489 | 7,357,488 | 11/635,490 | 11/635,525 |
| 7,287,706 | 11/706,366 | 11/706,310 | 11/706,308 | 11/785,108 | 11/744,214 | 7,362,971 |
| 11,748,485 | 7,350,906 | 11/764,778 | 11/766,025 | 11/834,635 | 11,839,541 | 11,860,420 |
| 11/865,693 | 11/863,118 | 11/866,307 | 11/866,340 | 11/869,684 | 11/869,722 | 11/869,694 |
| 11/876,592 | 11/945,244 | 11,951,121 | 11/945,238 | 11,955,358 | 11,965,710 | 11,962,050 |
| 12,015,478 | 12,015,423 | 12,015,434 | 12,023,015 | 12,030,755 | 12,025,641 | 12,056,228 |
| 12,036,279 | 12,031,598 | 12,050,949 | 12,056,217 | 12,104,411 | | |

BACKGROUND OF THE INVENTION

The present Applicant has described previously a plethora of MEMS inkjet nozzles using thermal bend actuation. Thermal bend actuation generally means bend movement generated by thermal expansion of one material, having a current passing therethough, relative to another material. The resulting bend movement may be used to eject ink from a nozzle opening, optionally via movement of a paddle or vane, which creates a pressure wave in a nozzle chamber.

Some representative types of thermal bend inkjet nozzles are exemplified in the patents and patent applications listed in the cross reference section above, the contents of which are incorporated herein by reference.

The Applicant's U.S. Pat. No. 6,416,167 describes an inkjet nozzle having a paddle positioned in a nozzle chamber and a thermal bend actuator positioned externally of the nozzle chamber. The actuator takes the form of a lower active beam of conductive material (e.g. titanium nitride) fused to an upper passive beam of non-conductive material (e.g. silicon dioxide). The actuator is connected to the paddle via an arm received through a slot in the wall of the nozzle chamber. Upon passing a current through the lower active beam, the actuator bends upwards and, consequently, the paddle moves towards a nozzle opening defined in a roof of the nozzle chamber, thereby ejecting a droplet of ink. An advantage of this design is its simplicity of construction. A drawback of this design is that both faces of the paddle work against the relatively viscous ink inside the nozzle chamber.

The Applicant's U.S. Pat. No. 6,260,953 describes an inkjet nozzle in which the actuator forms a moving roof portion of the nozzle chamber. The actuator takes the form of a serpentine core of conductive material encased by a polymeric material. Upon actuation, the actuator bends towards a floor of the nozzle chamber, increasing the pressure within the chamber and forcing a droplet of ink from a nozzle opening defined in the roof of the chamber. The nozzle opening is defined in a non-moving portion of the roof. An advantage of this design is that only one face of the moving roof portion has to work against the relatively viscous ink inside the nozzle chamber. A drawback of this design is that construction of the actuator from a serpentine conductive element encased by polymeric material is difficult to achieve in a MEMS fabrication process.

The Applicant's U.S. Pat. No. 6,623,101 describes an inkjet nozzle comprising a nozzle chamber with a moveable roof portion having a nozzle opening defined therein. The moveable roof portion is connected via an arm to a thermal bend actuator positioned externally of the nozzle chamber. The actuator takes the form of an upper active beam spaced apart from a lower passive beam. By spacing the active and passive beams apart, thermal bend efficiency is maximized since the passive beam cannot act as heat sink for the active beam. Upon passing a current through the active upper beam, the moveable roof portion, having the nozzle opening defined therein, is caused to rotate towards a floor of the nozzle chamber, thereby ejecting through the nozzle opening. Since the nozzle opening moves with the roof portion, drop flight direction may be controlled by suitable modification of the shape of the nozzle rim. An advantage of this design is that only one face of the moving roof portion has to work against the relatively viscous ink inside the nozzle chamber. A further advantage is the minimal thermal losses achieved by spacing apart the active and passive beam members. A drawback of this design is the loss of structural rigidity in spacing apart the active and passive beam members.

There is a need to improve on the bend actuation efficiency of thermal bend actuators.

SUMMARY OF THE INVENTION

In a first aspect the present invention provides a thermal bend actuator, comprising:

- a pair of electrical contacts positioned at one end of said actuator;
- an active beam connected to said electrical contacts and extending longitudinally away from said contacts, said active beam defining a bent current flow path between said contacts; and
- a passive beam fused to said active beam, such that when a current is passed through the active beam, the active beam heats and expands relative to the passive beam, resulting in bending of the actuator, wherein said active beam comprises at least one resistive heating bar, said heating bar having a relatively smaller cross-sectional area than any other part of said current flow path, such that heating of said active beam is concentrated in said heating bar.

Optionally, said active beam comprises a first arm extending longitudinally from a first contact, a second arm extending longitudinally from a second contact and a connecting member connecting said first and second arms.

Optionally, each of said first and second arms comprises a respective resistive heating bar.

Optionally, said connecting member interconnects distal ends of said first and second arms, said distal ends being distal relative to said electrical contacts.

Optionally, said at least one resistive heating bar has a cross-sectional area which is at least 1.5 times smaller than a cross-sectional area of any other part of said current flow path.

Optionally, said at least one resistive heating bar has a width of less than 3 microns.

Optionally, said connecting member occupies at least 30% of a total volume of said active beam.

Optionally, said active beam is connected to drive circuitry via said pair of electrical contacts.

Optionally, said drive circuitry is configured to deliver actuation pulses to said active beam, each actuation pulse having a pulse width of less than 0.2 microseconds.

Optionally, said active beam is comprised of a material selected from the group comprising: titanium nitride, titanium aluminium nitride and a vanadium-aluminium alloy.

Optionally, said passive beam is comprised of a material selected from the group comprising: silicon dioxide, silicon nitride and silicon oxynitride.

In a further aspect there is provided an inkjet nozzle assembly comprising:

- a nozzle chamber having a nozzle opening and an ink inlet;
- a pair of electrical contacts positioned at one end of said assembly and connected to drive circuitry; and
- a thermal bend actuator for ejecting ink through the nozzle opening, said actuator comprising:
  - an active beam connected to said electrical contacts and extending longitudinally away from said contacts, said active beam defining a bent current flow path between said contacts; and
  - a passive beam fused to said active beam, such that when a current is passed through the active beam, the active beam heats and expands relative to the passive beam, resulting in bending of the actuator, wherein said active beam comprises a resistive heating bar, said heating bar having a relatively smaller cross-sectional area than any other part of said current flow path, such that heating of said active beam is concentrated in said at least one heating bar.

Optionally, the nozzle chamber comprises a floor and a roof having a moving portion, whereby actuation of said actuator moves said moving portion towards said floor.

Optionally, said moving portion comprises said actuator.

Optionally, the nozzle opening is defined in the moving portion, such that the nozzle opening is moveable relative to the floor.

Optionally, the actuator is moveable relative to the nozzle opening.

Optionally, said active beam comprises a first arm extending longitudinally from a first contact, a second arm extending longitudinally from a second contact and a connecting member connecting said first and second arms, and wherein each of said arms comprises a respective resistive heating bar.

Optionally, said resistive heating bars together occupy less than 50% of a total volume of said active beam.

Optionally, said drive circuitry is configured to deliver actuation pulses to said active beam, each actuation pulse having a pulse width of less than 0.2 microseconds.

In a further aspect there is provided an inkjet printhead comprising a plurality of nozzle assemblies comprising:

a nozzle chamber having a nozzle opening and an ink inlet;

a pair of electrical contacts positioned at one end of said assembly and connected to drive circuitry; and a thermal bend actuator for ejecting ink through the nozzle opening, said actuator comprising:

an active beam connected to said electrical contacts and extending longitudinally away from said contacts, said active beam defining a bent current flow path between said contacts; and a passive beam fused to said active beam, such that when a current is passed through the active beam, the active beam heats and expands relative to the passive beam, resulting in bending of the actuator, wherein said active beam comprises a resistive heating bar, said heating bar having a relatively smaller cross-sectional area than any other part of said current flow path, such that heating of said active beam is concentrated in said at least one heating bar.

In a second aspect the present invention provides a method of actuating a thermal bend actuator having an active beam fused to a passive beam, said method comprising passing an electrical current through said active beam so as to cause thermoelastic expansion of said active beam relative to said passive beam and bending of said actuator, wherein said current is delivered in an actuation pulse having a pulse width of less than 0.2 microseconds.

Optionally, said pulse width is 0.1 microseconds or less.

Optionally, a total amount of energy delivered in said actuation pulse is less than 200 nJ.

Optionally, a total amount of energy delivered in each actuation pulse is less than 150 nJ.

Optionally, said actuation pulse causes a peak deflection velocity in said bend actuator of at least 2.0 m/s Optionally, said active beam comprises a resistive heating bar, said heating bar having a relatively smaller cross-sectional area than any other part of said active beam, such that heating of said active beam is concentrated in said at least one heating bar.

Optionally, said thermal bend actuator comprises:

a pair of electrical contacts positioned at one end of said actuator;

an active beam connected to said electrical contacts and extending longitudinally away from said contacts, said active beam defining a bent current flow path between said contacts; and a passive beam fused to said active beam, such that when a current is passed through the active beam, the active beam heats and expands relative to the passive beam, resulting in bending of the actuator, wherein said active beam comprises a resistive heating bar, said heating bar having a relatively smaller cross-sectional area than any other part of said current flow path, such that heating of said active beam is concentrated in said at least one heating bar.

Optionally, said active beam comprises a first arm extending longitudinally from a first contact, a second arm extending longitudinally from a second contact and a connecting member connecting said first and second arms.

Optionally, each of said first and second arms comprises a respective resistive heating bar.

Optionally, said connecting member interconnects distal ends of said first and second arms, said distal ends being distal relative to said electrical contacts.

Optionally, said at least one resistive heating bar has a cross-sectional area which is at least 1.5 times smaller than a cross-sectional area of any other part of said active beam.

Optionally, said at least one resistive heating bar has a width of less than 3 microns.

Optionally, said connecting member occupies at least 30% of a total volume of said active beam.

Optionally, said active beam is connected to drive circuitry via said pair of electrical contacts, said drive circuitry being configured to deliver said actuation pulses to said active beam.

Optionally, said active beam is comprised of a material selected from the group comprising: titanium nitride, titanium aluminium nitride and a vanadium-aluminium alloy.

Optionally, said passive beam is comprised of a material selected from the group comprising: silicon dioxide, silicon nitride and silicon oxynitride.

In a further aspect there is provided a method of ejecting ink from an inkjet nozzle assembly, said nozzle assembly comprising:

a nozzle chamber having a nozzle opening and an ink inlet;

a pair of electrical contacts connected to drive circuitry; and a thermal bend actuator for ejecting ink through the nozzle opening, said thermal bend actuator comprising an active beam connected to said electrical contacts and a passive beam fused to said active beam, said method comprising passing an electrical current through said active beam so as to cause thermoelastic expansion of said active beam relative to said passive beam and bending of said actuator resulting in ejection of ink from said nozzle chamber, wherein said current is delivered in an actuation pulse having a pulse width of less than 0.2 microseconds.

Optionally, the nozzle chamber comprises a floor and a roof having a moving portion, whereby actuation of said actuator moves said moving portion towards said floor.

Optionally, said moving portion comprises said actuator.

Optionally, the nozzle opening is defined in the moving portion, such that the nozzle opening is moveable relative to the floor.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
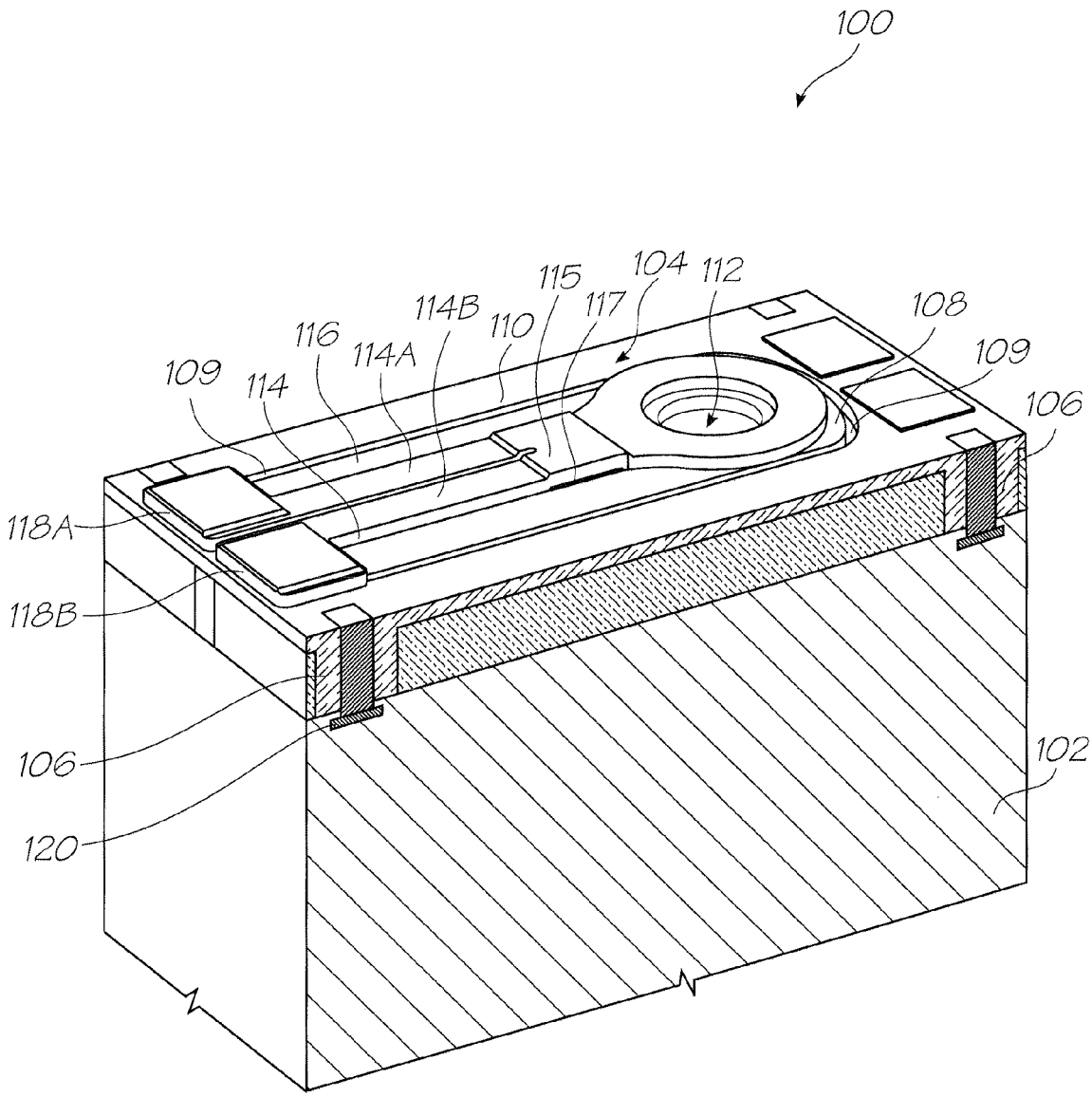
FIG. 1 is a cutaway perspective of a partially-fabricated inkjet nozzle assembly.
Figure 2:
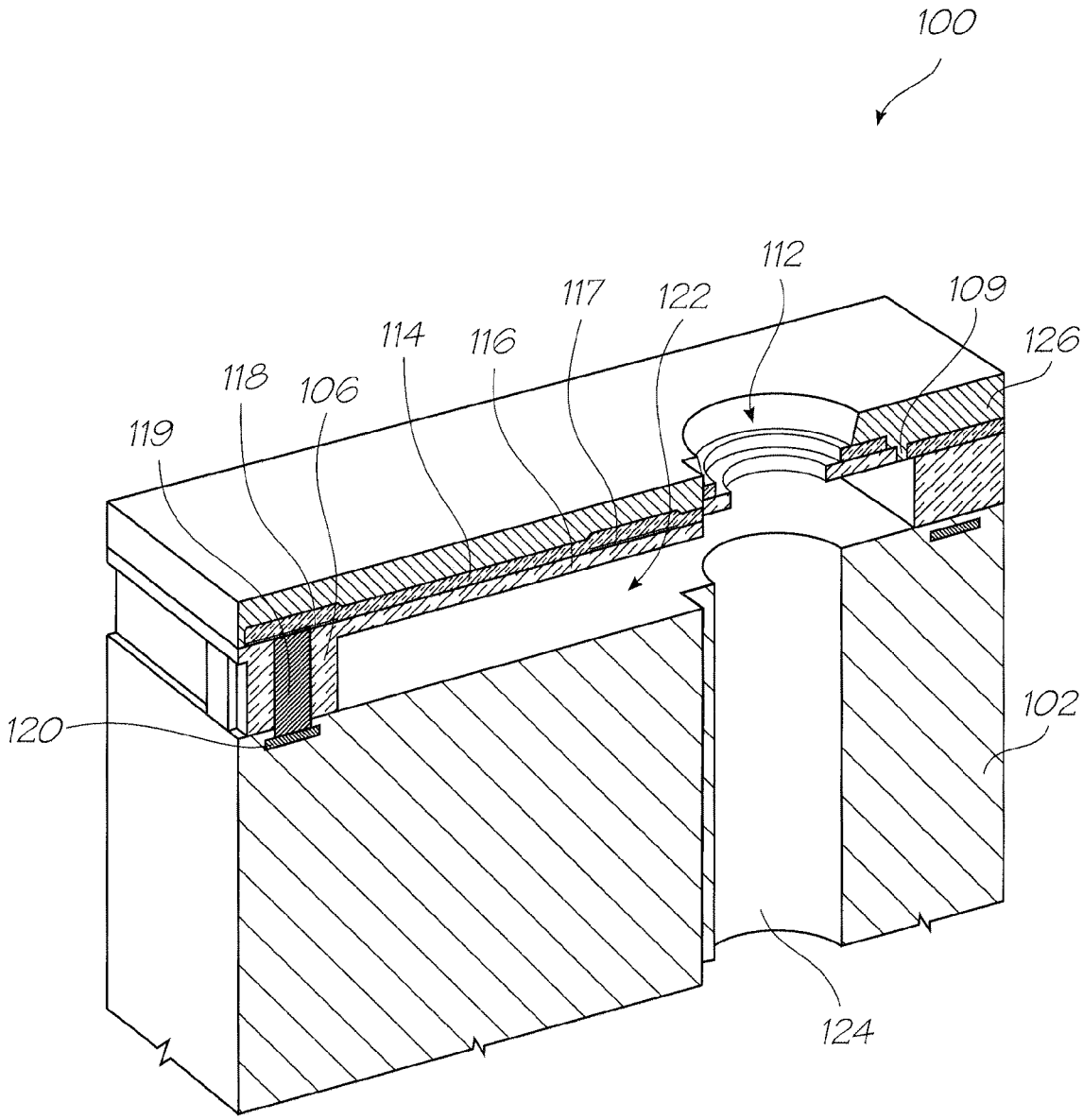
FIG. 2 is a cutaway perspective of the inkjet nozzle assembly shown in FIG. 1 after completion of final-stage fabrication steps.

FIGS. 1 and 2 show a nozzle assembly 100 at two different stages of fabrication, as described in the Applicant's earlier filed U.S. application Ser. No. 11/763,440 filed on Jun. 15, 2007, the contents of which is incorporated herein by reference.

FIG. 1 shows the nozzle assembly partially formed so as to illustrate the features of active and passive beam layers. Thus, referring to FIG. 1, there is shown the nozzle assembly 100 formed on a CMOS silicon substrate 102. A nozzle chamber is defined by a roof 104 spaced apart from the substrate 102 and sidewalls 106 extending from the roof to the substrate 102. The roof 104 is comprised of a moving portion 108 and a stationary portion 110 with a gap 109 defined therebetween. A nozzle opening 112 is defined in the moving portion 108 for ejection of ink.

The moving portion 108 comprises a thermal bend actuator having a pair of cantilever beams in the form of an upper active beam 114 fused to a lower passive beam 116. The lower passive beam 116 defines the extent of the moving portion 108 of the roof. The upper active beam 114 comprises a pair of arms 114A and 114B which extend longitudinally from respective electrode contacts 118A and 118B. The arms 114A and 114B are connected at their distal ends by a connecting member 115. The connecting member 115 comprises a titanium conductive pad 117, which facilitates electrical conduction around this join region. Hence, the active beam 114 defines a bent or tortuous conduction path between the electrode contacts 118A and 118B.

The electrode contacts 118A and 118B are positioned adjacent each other at one end of the nozzle assembly and are connected via respective connector posts 119 to a metal CMOS layer 120 of the substrate 102. The CMOS layer 120 contains the requisite drive circuitry for actuation of the bend actuator.

The passive beam 116 is typically comprised of any electrically/thermally-insulating material, such as silicon dioxide, silicon nitride etc. The thermoelastic active beam 114 may be comprised of any suitable thermoelastic material, such as titanium nitride, titanium aluminium nitride and aluminium alloys. As explained in the Applicant's copending U.S. application Ser. No. 11/607,976 filed on 4 Dec. 2006 , vanadium-aluminium alloys are a preferred material, because they combine the advantageous properties of high thermal expansion, low density and high Young's modulus.

Referring to FIG. 2, there is shown a completed nozzle assembly 100 at a subsequent stage of fabrication. The nozzle assembly of FIG. 2 has a nozzle chamber 122 and an ink inlet 124 for supply of ink to the nozzle chamber. In addition, the entire roof is covered with a layer of polymeric material 126, such as polydimethylsiloxane (PDMS). The polymeric layer 126 has a multitude of functions, including: protection of the bend actuator, hydrophobizing the roof 104 and providing a mechanical seal for the gap 109. The polymeric layer 126 has a sufficiently low Young's modulus to allow actuation and ejection of ink through the nozzle opening 112. A more detailed description of the polymeric layer 126, including its functions and fabrication, can be found in, for example, U.S. application Ser. No. 11/946,840 filed on Nov. 29, 2007.

When it is required to eject a droplet of ink from the nozzle chamber 122, a current flows through the active beam 114 between the electrode contacts 118. The active beam 114 is rapidly heated by the current and expands relative to the passive beam 116, thereby causing the moving portion 108 to bend downwards towards the substrate 102 relative to the stationary portion 110. This movement, in turn, causes ejection of ink from the nozzle opening 112 by a rapid increase of pressure inside the nozzle chamber 122. When current stops flowing, the moving portion 108 is allowed to return to its quiescent position, shown in FIGS. 1 and 2, which sucks ink from the inlet 124 into the nozzle chamber 122, in readiness for the next ejection.

In the nozzle design shown in FIGS. 1 and 2, it is advantageous for the bend actuator to define at least part of the moving portion 108 of each nozzle assembly 100. This not only simplifies the overall design and fabrication of the nozzle assembly 100, but also provides higher ejection efficiency because only one face of the moving portion 108 has to do work against the relatively viscous ink. By comparison, nozzle assemblies having an actuator paddle positioned inside the nozzle chamber 122 are less efficient, because both faces of the actuator have to do work against the ink inside the chamber.

However, there is still a need to improve the overall efficiency of the bend actuator. Electrical losses can occur in the connecting member 115 due to the sharp bend in the current flow path; and thermal losses can occur by transfer of heat from the active layer 114 to the passive layer 116.

Figure 3:
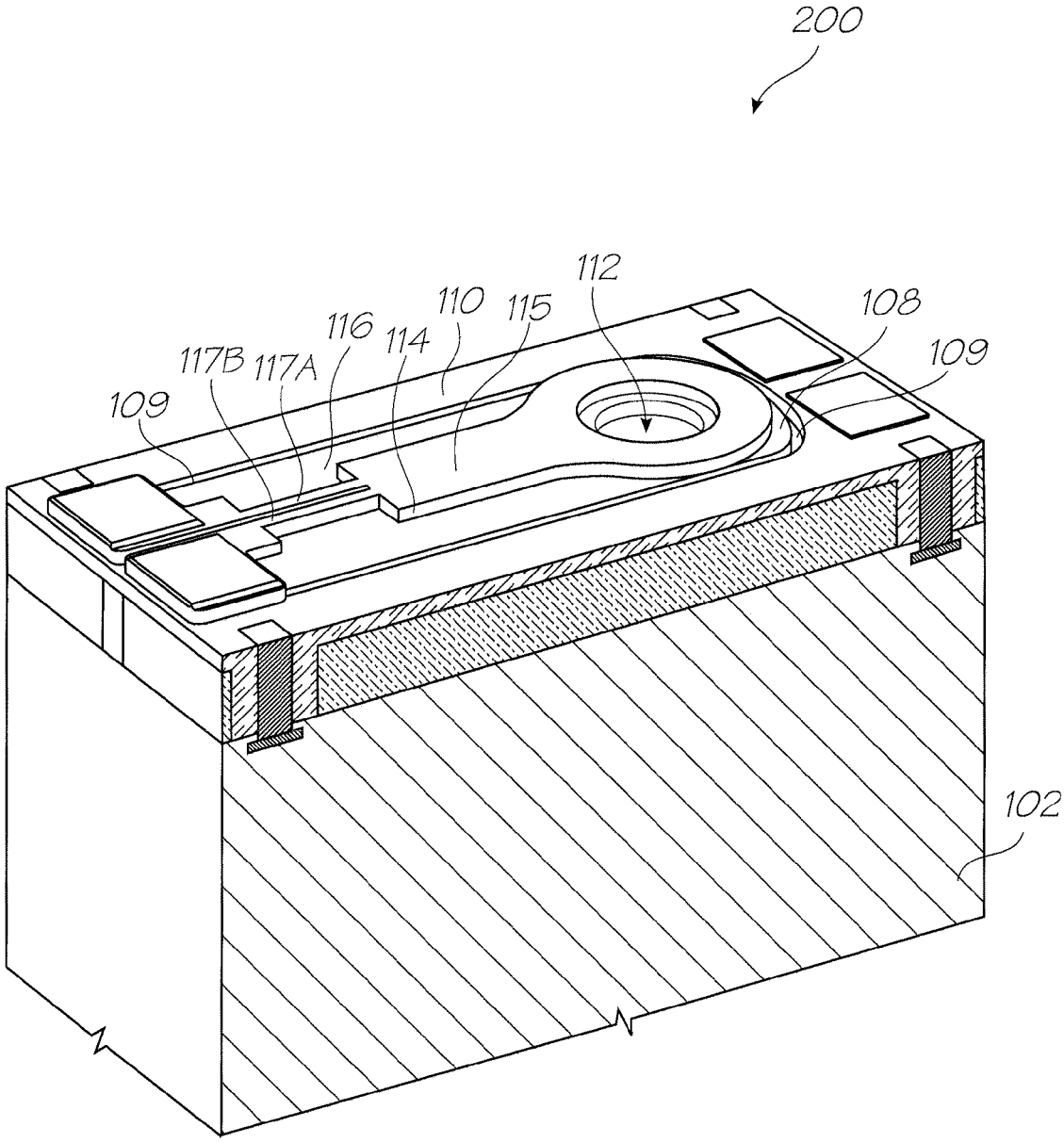
FIG. 3 is a cutaway perspective of a partially-fabricated inkjet nozzle assembly according to the present invention.

Turning now to FIG. 3, there is shown a partially-fabricated nozzle assembly 200 having a different configuration of the active beam layer 114. In the interests of clarity, like nozzle features are designated with the same references numerals used in FIGS. 1 and 2.

The nozzle assembly 200 is at the same stage of fabrication as the nozzle assembly 100 shown in FIG. 1. Of course, the nozzle assembly 200 may be subsequently processed to provide a completed nozzle assembly similar to that shown in FIG. 2. However, the partially-fabricated nozzle assembly 200 of FIG. 3 best illustrates the salient features of the active beam layer 114.

In FIG. 3, it can be seen that the active beam 114 comprises a pair of resistive heating bars 117A and 117B having a smaller area in transverse cross-section (relative to the longitudinal current flow direction) than any other part of the current flow path defined by the active beam 114. Typically, each heating bar 117 has a cross-sectional area which is at least 1.5 times, at least 2 times, at least 3 times or at least 4 times smaller than a cross-sectional area of any other part of the current flow path. Hence, the heating bars 117 generate an overwhelming majority of the heat in the active beam 114 which is required for thermoelastic bend actuation.

The heating bars 117 together occupy a relatively small region of the moving part 108. Typically, less than 10% or less than 5% of the total area of the moving part 108 is occupied by the heating bars 117. The heating bars together occupy a relatively small volume of the active beam 114. Typically, less than 50%, less than 40% or less than 30% of the total volume (and/or area) of the active beam 114 is occupied by the heating bars 117. Typically, the heater bars 117 have a width or a height dimension of less than 3 microns, less than 2.5 microns or less than 2 microns.

This configuration of the active beam 114 provides a number of advantages over the configuration shown in FIG. 1. Firstly, by concentrating heat into a relatively small region, the total amount of heat transferred from the active beam 114 to the passive beam 116 during thermoelastic actuation is minimized. Thus, for a same amount of energy input, the thermal losses in nozzle assembly 200 are less compared to the nozzle assembly 100 shown in FIG. 1.

Secondly, the connecting member 115 of the active beam 114 can be made larger, which minimizes current losses due to the sharp bend (180 degree bend) in the current flow path, and may obviate the need for the conduction pad 117. The majority of the active beam 114 of nozzle assembly 200 is dedicated to maximizing current flow into the heating bars 117, which are responsible for thermoelastic actuation. Typically, the connecting member 115 occupies at least 30% or at least 40% of the total volume of the active beam 114.

The nozzle assembly shown in FIG. 3 is particularly efficacious when used in combination with short actuation pulses. By using a shorter pulse, the amount of time for transfer of thermal energy into the passive layer 116 is minimized, resulting in smaller thermal losses compared to a longer actuation pulse. Moreover, the configuration of the resistive heating bars 117 in combination with a short actuation pulse generates a greater temperature difference between the active layer 114 and the passive layer 116. Hence, greater differential expansion between the layers is achieved, which results in a higher peak deflection velocity of the moving part 108. The peak deflection velocity of the moving part 108 is the critical factor governing ink ejection velocity from the nozzle opening 112.

Figure 4:
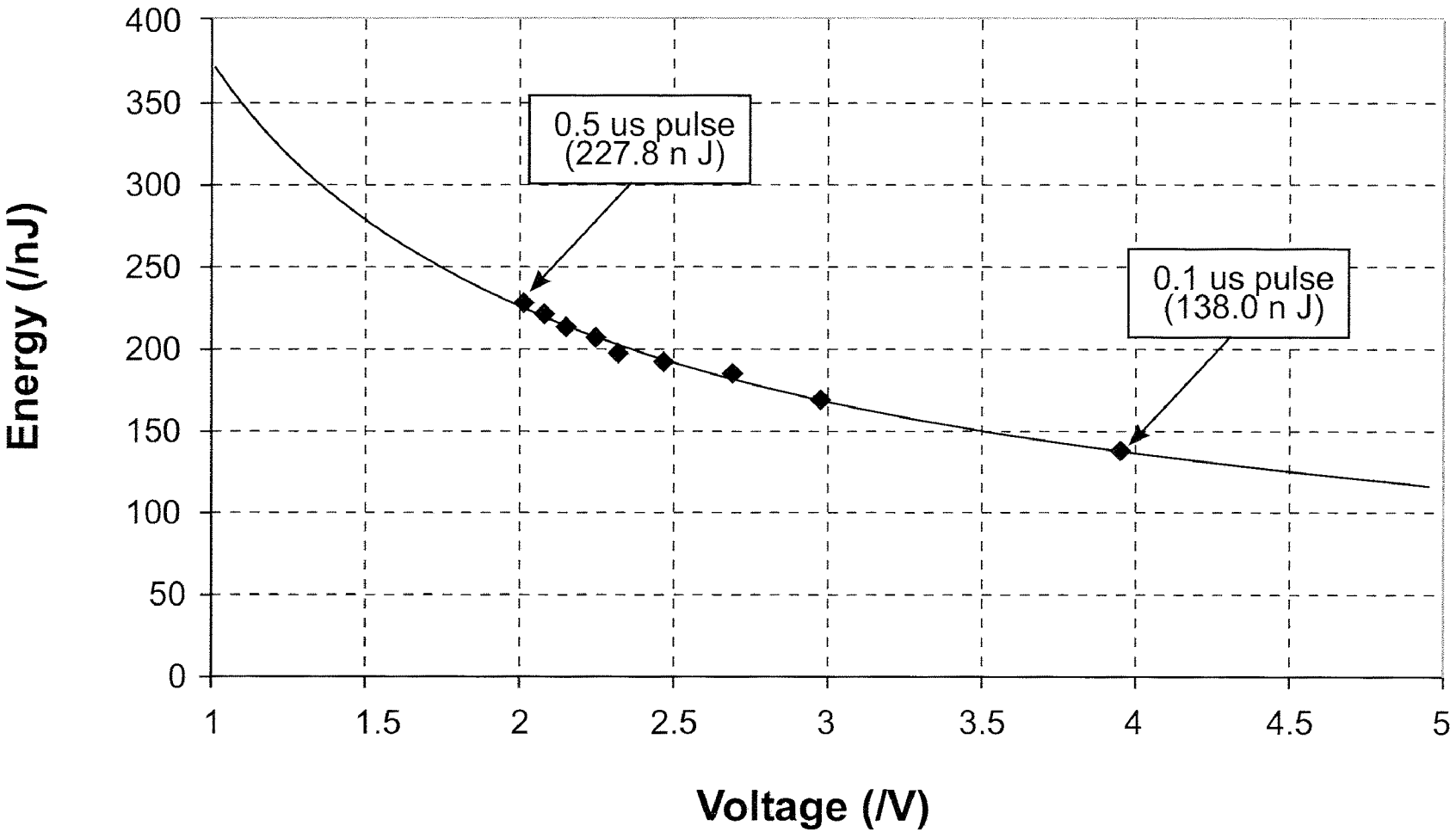
FIG. 4 is a graph showing variation of energy inputs required to achieve a peak deflection velocity of 3 m/s using different actuation pulse widths.

FIG. 4 shows experimentally how more efficient thermoelastic actuation and drop ejection is achieved using the nozzle assembly 200 with a relatively short actuation pulse. The graph shows the amount of energy required to achieve a peak deflection velocity of 3 m/s for various actuation pulse widths in the range of 0.5 to 0.1 microseconds (separated by 0.05 microsecond intervals). The first data point has an actuation pulse width of 0.5 microseconds and requires a total energy input of 227.9 nJ to achieve a peak deflection velocity of 3 m/s. By contrast, the last data point has an actuation pulse width of 0.1 microseconds and requires a total energy input of only 138 nJ to achieve the same peak deflection velocity of 3 m/s. Hence, the experimental data clearly illustrates that shorter pulse widths achieve more efficient actuation, especially in the nozzle assembly 200 shown in FIG. 3.

Typically, the total amount of energy input required for actuation in the present invention is reduced to less than 200 nJ or less than 150 nJ. Usually, the total energy input is in the range of 100-200 nJ or 100-150 nJ.

The skilled person will readily appreciate the advantages of overall lower energy input into thermal bend actuators in order to generate a predetermined peak deflection velocity. Thermal bend-actuated inkjet printheads may be made more efficient and require less power, in accordance with the bend actuators and methods described herein.

It will, of course, be appreciated that the present invention has been described by way of example only and that modifications of detail may be made within the scope of the invention, which is defined in the accompanying claims.

The invention claimed is:

1. An inkjet nozzle assembly comprising:

a nozzle chamber comprising an ink inlet, a floor and a roof, said roof having a moving portion and a nozzle opening;

a pair of electrical contacts positioned at one end of said assembly and connected to drive circuitry; and a thermal bend actuator defining at least part of said moving portion, whereby actuation of said actuator moves said moving portion towards said floor, said actuator comprising:

an active beam connected to said electrical contacts and extending longitudinally away from said contacts, said active beam defining a bent current flow path between said contacts; and a passive beam fused to said active beam, such that when a current is passed through the active beam, the active beam heats and expands relative to the passive beam, resulting in bending of the actuator, wherein said active beam comprises a resistive heating bar, said heating bar having a relatively smaller cross-sectional area than any other part of the bent current flow path defined by the active beam, such that heating of said active beam is concentrated in said at least one heating bar.

2. The inkjet nozzle assembly of claim 1, wherein the nozzle opening is defined in the moving portion, such that the nozzle opening is moveable relative to the floor.

3. The inkjet nozzle assembly of claim 1, wherein the actuator is moveable relative to the nozzle opening.

4. The inkjet nozzle assembly of claim 1, wherein said active beam comprises a first arm extending longitudinally from a first contact, a second arm extending longitudinally from a second contact and a connecting member connecting said first and second arms, and wherein each of said arms comprises a respective resistive heating bar.

5. The inkjet nozzle assembly of claim 1, wherein said drive circuitry is configured to deliver actuation pulses to said active beam, each actuation pulse having a pulse width of less than 0.2 microseconds.

6. An inkjet printhead comprising a plurality of nozzle assemblies according to claim 1.

7. The inkjet nozzle assembly of claim 4, wherein said resistive heating bars together occupy less than 50% of a total volume of said active beam.

* * * * *